US009873275B2

(12) United States Patent
Ito et al.

(10) Patent No.: US 9,873,275 B2
(45) Date of Patent: Jan. 23, 2018

(54) IMAGE FORMING APPARATUS, AND METHOD AND COMPUTER-READABLE MEDIUM THEREFOR

(71) Applicant: BROTHER KOGYO KABUSHIKI KAISHA, Nagoya, Aichi (JP)

(72) Inventors: Tsuyoshi Ito, Aichi (JP); Kohei Terada, Kiyosu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/433,315

(22) Filed: Feb. 15, 2017

(65) Prior Publication Data

US 2017/0232771 A1 Aug. 17, 2017

(30) Foreign Application Priority Data

Feb. 16, 2016 (JP) ..... 2016-026984

(51) Int. Cl.

| | |
|---|---|
| ***B41J 29/393*** | (2006.01) |
| ***B41J 2/045*** | (2006.01) |
| ***B41J 11/42*** | (2006.01) |
| ***B41J 13/00*** | (2006.01) |

(52) U.S. Cl.

CPC ..... *B41J 29/393* (2013.01); *B41J 2/04506* (2013.01); *B41J 2/04558* (2013.01); *B41J 11/42* (2013.01); *B41J 13/0027* (2013.01)

(58) Field of Classification Search

CPC .. B41J 29/393; B41J 2/04506; B41J 2/04558; B41J 13/0027; B41J 11/42

See application file for complete search history.

(56) References Cited

U.S. PATENT DOCUMENTS 5,297,871 A * 3/1994 Fujioka ..... B41J 2/505 400/568
5,674,019 A * 10/1997 Munakata ..... B41J 11/0085 400/568

(Continued)

FOREIGN PATENT DOCUMENTS

JP 11049399 A * 2/1999 ..... B41J 11/42
JP 2002-273956 A 9/2002

(Continued)

*Primary Examiner* — Julian Huffman
(74) *Attorney, Agent, or Firm* — Scully, Scott, Murphy & Presser, PC

(57) ABSTRACT

An image forming apparatus includes a controller configured to, each time an unpaired first pattern element formed on a recording medium is conveyed over a particular distance in a conveyance direction in response to a conveyor rotating by a first amount, control an image former to form a second pattern element to be paired with the unpaired first pattern element thereby forming a first test pattern, and each time an unpaired third pattern element formed on the recording medium is conveyed over a specific distance in the conveyance direction in response to the conveyor rotating by a second amount, control the image former to form a fourth pattern element to be paired with the unpaired third pattern element thereby forming a second test pattern. At least one of the first and second amounts is a non-integer multiple of a rotation amount of the conveyor that makes a single rotation.

20 Claims, 13 Drawing Sheets

(56) References Cited

U.S. PATENT DOCUMENTS

| | | | | |
|---|---|---|---|---|
| 6,101,426 | A * | 8/2000 | Kimura | B41J 11/42 271/265.01 |
| 6,126,345 | A * | 10/2000 | Ito | B41J 13/0027 400/283 |
| 6,568,784 | B2 * | 5/2003 | Izumi | B41J 2/01 347/16 |
| 6,805,424 | B2 * | 10/2004 | Seshimo | G01D 15/24 347/16 |
| 7,093,917 | B2 * | 8/2006 | Yamada | B41J 29/393 347/16 |
| 7,530,657 | B2 * | 5/2009 | Thiessen | H04N 1/0473 347/101 |
| 2002/0130915 | A1 | 9/2002 | Izumi et al. | |
| 2004/0061767 | A1 * | 4/2004 | Yamada | B41J 2/325 347/215 |
| 2008/0007586 | A1 * | 1/2008 | Yoshida | B41J 29/38 347/16 |
| 2008/0192270 | A1 * | 8/2008 | Nakano | G06K 15/16 358/1.9 |
| 2008/0252676 | A1 * | 10/2008 | Yasutani | B41J 29/38 347/16 |
| 2008/0266348 | A1 * | 10/2008 | Seki | B41J 29/393 347/19 |
| 2012/0081447 | A1 | 4/2012 | Nakano et al. | |

FOREIGN PATENT DOCUMENTS

| | | | |
|---|---|---|---|
| JP | 2008-260166 | A | 10/2008 |
| JP | 2012-076245 | A | 4/2012 |

* cited by examiner

Q
PE1
PE3
N1

Q
PE1
PE2
TP1
PE1
PE3
L1
PE3
N2
N1

Q
PE1
PE2
TP1
PE1
PE2
TP1
PE1
PE3
L1
PE3
L1
PE3
N2
N1

Q
PE1
PE2
TP1
PE1
PE2
TP1
PE1
PE2
TP1
PE1
PE3
L1
PE3
L1
PE3
L1
PE3
N2
N1

Q
PE1
PE2
TP1
PE1
PE2
TP1
PE1
PE2
TP1
PE1
PE2
TP1
PE1
PE3
PE3
PE3
PE3
PE3
N2
N1

IMAGE FORMING APPARATUS, AND METHOD AND COMPUTER-READABLE MEDIUM THEREFOR

CROSS-REFERENCE TO RELATED APPLICATION

This application claims priority under 35 U.S.C. § 119 from Japanese Patent Application No. 2016-026984 filed on Feb. 16, 2016. The entire subject matter of the application is incorporated herein by reference.

BACKGROUND

Technical Field

The following description relates to aspects of an image forming apparatus, and a method and a computer-readable medium therefor.

Related Art

Heretofore, various image forming apparatuses have been known such as serial printers (e.g., inkjet printers and dot impact printers) and electrophotographic page printers (e.g., laser printers and LED printers).

Further, an image forming apparatus has been known that is configured to form test patterns on a recording medium, so as to form a high-quality image by suppressing a conveyance distance error caused when the recording medium is conveyed. For instance, the known image forming apparatus may be configured to divide a single rotation (i.e., one-cycle rotation) of a conveyance roller into a plurality of angle sections, and form a ruled line along a main scanning direction each time the recording medium is conveyed over a distance corresponding to an individual angle section of the conveyance roller. Thereby, a test pattern group including a plurality of ruled lines arranged in a sub scanning direction is formed on the recording medium.

Further, the known image forming apparatus may be configured to detect an interval between two adjoining ruled lines in the sub scanning direction, calculate an average value of a plurality of intervals detected for a specific one of the angle sections, and adjust a conveyance distance for the same specific angle section of the conveyance roller based on the calculated average value.

SUMMARY

According to the aforementioned known image forming apparatus, the conveyance distance for each angle section of the conveyance roller is adjusted under an assumption that a conveyance distance of the recording medium conveyed by each single rotation of the conveyance roller is constant. However, in general, a conveyance distance error caused when the recording medium is conveyed contains an aperiodic component that is not dependent on periodic factors such as eccentricity of the conveyance roller. For instance, a conveyance path for conveying a sheet (which is an example of the recording medium) includes a curving section. In this case, a sheet curved when being conveyed along the curving section of the conveyance path recovers to a non-curved state after entirely passing through the curving section. At a stage where the sheet is recovering to the non-curved state, the sheet may receive a force to urge the sheet to go forward in a conveyance direction. Further, when a trailing end of the sheet in the conveyance direction passes through a pickup roller disposed upstream of the conveyance roller in the conveyance direction, the sheet receives a force to push the sheet forward. Thus, the conveyance distance error of the recording medium varies aperiodically depending on influences of a shape of the conveyance path and a structure for conveying the recording medium.

Namely, the conveyance distance of the recording medium conveyed by each single rotation of the conveyance roller is not necessarily constant. Therefore, for the known image forming apparatus designed based on the assumption that such a conveyance distance is constant, it is difficult to accurately adjust the conveyance distance when the conveyance distance error contains periodic and aperiodic components.

Aspects of the present disclosure are advantageous to provide one or more improved techniques for forming, on a recording medium, test patterns to accurately detect a periodic component and an aperiodic component contained in a conveyance distance error.

According to aspects of the present disclosure, an image forming apparatus is provided that includes a conveyor configured to, while rotating, convey a recording medium in a conveyance direction, an image former configured to form an image on the recording medium conveyed by the conveyor, and a controller. The controller is configured to perform a test pattern forming process to form on the recording medium a plurality of first test patterns arranged in the conveyance direction and a plurality of second test patterns arranged in the conveyance direction, each first test pattern including a pair of a first pattern element and a second pattern element, each second test pattern including a pair of a third pattern element and a fourth pattern element. The test pattern forming process includes controlling the image former to form a first pattern element on the recording medium, after the first pattern element is formed, controlling the conveyor to rotate by a first amount and convey the recording medium with the first pattern element formed thereon over a particular distance corresponding to the first amount in the conveyance direction, after the first pattern element formed on the recording medium is conveyed over the particular distance in the conveyance direction in response to the conveyor rotating by the first amount, controlling the image former to form a second pattern element to be paired with the first pattern element formed on the recording medium thereby forming a first test pattern, and form an unpaired first pattern element, after the unpaired first pattern element is formed, each time the unpaired first pattern formed on the recording medium is conveyed over the particular distance in the conveyance direction in response to the conveyor rotating by the first amount, controlling the image former to form another second pattern element to be paired with the unpaired first pattern element thereby forming another first test pattern, controlling the image former to form a third pattern element on the recording medium, after the third pattern element is formed, controlling the conveyor to rotate by a second amount and convey the recording medium with the third pattern element formed thereon over a specific distance corresponding to the second amount in the conveyance direction, wherein the second amount is different from the first amount, and at least one of the first amount and the second amount is a non-integer multiple of a rotation amount of the conveyor that makes a single rotation, after the third pattern element formed on the recording medium is conveyed over the specific distance in the conveyance direction in response to the conveyor rotating by the second amount, controlling the image former to form a fourth pattern element to be paired with the third pattern element formed on the recording medium thereby forming a second test pattern, and form an unpaired third pattern element, and after the unpaired third pattern element is formed, each time the unpaired third pattern formed on the recording medium is conveyed over the specific distance in the conveyance direction in response to the conveyor rotating by the second amount, controlling the image former to form another fourth pattern element to be paired with the unpaired third pattern element thereby forming another second test pattern.

According to aspects of the present disclosure, by analyzing the plurality of first test patterns formed on the recording medium, it is possible to detect a conveyance distance error caused when the recording medium is conveyed in response to the conveyor rotating by the first amount. In addition, by analyzing the plurality of second test patterns formed on the recording medium, it is possible to detect a conveyance distance error caused when the recording medium is conveyed in response to the conveyor rotating by the second amount. Further, the plurality of first test patterns are arranged in the conveyance direction, and the plurality of second test patterns are arranged in the conveyance direction. Hence, from each of the first and second test patterns, it is possible to detect a conveyance distance error in a conveyance section of the recording medium and a phase section of the rotation of the conveyor between when one of the two pattern elements included in the test pattern is formed and when the other pattern element is formed. Thus, based on a group of the conveyance distance error detected from each of the first and second test patterns, it is possible to detect a periodic component and an aperiodic component of the conveyance distance error.

According to aspects of the present disclosure, further provided is a method implementable on a processor coupled with an image forming apparatus including a conveyor and an image former. The method includes controlling the image former to form a first pattern element on a recording medium, after the first pattern element is formed, controlling the conveyor to rotate by a first amount and convey the recording medium with the first pattern element formed thereon over a particular distance corresponding to the first amount in a conveyance direction, after the first pattern element formed on the recording medium is conveyed over the particular distance in the conveyance direction in response to the conveyor rotating by the first amount, controlling the image former to form a second pattern element to be paired with the first pattern element formed on the recording medium thereby forming a first test pattern, and form an unpaired first pattern element, the first test pattern including the pair of the first pattern element and the second pattern element, after the unpaired first pattern element is formed, each time the unpaired first pattern formed on the recording medium is conveyed over the particular distance in the conveyance direction in response to the conveyor rotating by the first amount, controlling the image former to form another second pattern element to be paired with the unpaired first pattern element thereby forming another first test pattern, controlling the image former to form a third pattern element on the recording medium, after the third pattern element is formed, controlling the conveyor to rotate by a second amount and convey the recording medium with the third pattern element formed thereon over a specific distance corresponding to the second amount in the conveyance direction, the second amount being different from the first amount, at least one of the first amount and the second amount being a non-integer multiple of a rotation amount of the conveyor that makes a single rotation, after the third pattern element formed on the recording medium is conveyed over the specific distance in the conveyance direction in response to the conveyor rotating by the second amount, controlling the image former to form a fourth pattern element to be paired with the third pattern element formed on the recording medium thereby forming a second test pattern, and form an unpaired third pattern element, the second test pattern including the pair of the third pattern element and the fourth pattern element, and after the unpaired third pattern element is formed, each time the unpaired third pattern formed on the recording medium is conveyed over the specific distance in the conveyance direction in response to the conveyor rotating by the second amount, controlling the image former to form another fourth pattern element to be paired with the unpaired third pattern element thereby forming another second test pattern.

According to aspects of the present disclosure, further provided is a non-transitory computer-readable medium storing computer-readable instructions executable on a processor coupled with an image forming apparatus including a conveyor and an image former. The instructions are configured to, when executed by the processor, cause the processor to control the image former to form a first pattern element on a recording medium, after the first pattern element is formed, control the conveyor to rotate by a first amount and convey the recording medium with the first pattern element formed thereon over a particular distance corresponding to the first amount in a conveyance direction, after the first pattern element formed on the recording medium is conveyed over the particular distance in the conveyance direction in response to the conveyor rotating by the first amount, control the image former to form a second pattern element to be paired with the first pattern element formed on the recording medium thereby forming a first test pattern, and form an unpaired first pattern element, the first test pattern including the pair of the first pattern element and the second pattern element, after the unpaired first pattern element is formed, each time the unpaired first pattern formed on the recording medium is conveyed over the particular distance in the conveyance direction in response to the conveyor rotating by the first amount, control the image former to form another second pattern element to be paired with the unpaired first pattern element thereby forming another first test pattern, control the image former to form a third pattern element on the recording medium, after the third pattern element is formed, control the conveyor to rotate by a second amount and convey the recording medium with the third pattern element formed thereon over a specific distance corresponding to the second amount in the conveyance direction, the second amount being different from the first amount, at least one of the first amount and the second amount being a non-integer multiple of a rotation amount of the conveyor that makes a single rotation, after the third pattern element formed on the recording medium is conveyed over the specific distance in the conveyance direction in response to the conveyor rotating by the second amount, control the image former to form a fourth pattern element to be paired with the third pattern element formed on the recording medium thereby forming a second test pattern, and form an unpaired third pattern element, the second test pattern including the pair of the third pattern element and the fourth pattern element, and after the unpaired third pattern element is formed, each time the unpaired third pattern formed on the recording medium is conveyed over the specific distance in the conveyance direction in response to the conveyor rotating by the second amount, control the image former to form another fourth pattern element to be paired with the unpaired third pattern element thereby forming another second test pattern.

BRIEF DESCRIPTION OF THE ACCOMPANYING DRAWINGS

FIG. 1 is a block diagram schematically showing a configuration of a multi-function peripheral (hereinafter referred to as an "MFP") in an illustrative embodiment according to one or more aspects of the present disclosure.

FIG. 2 schematically shows a configuration of a sheet conveyor, including a partial configuration around a recording head, of the MFP in the illustrative embodiment according to one or more aspects of the present disclosure.

Figure 6:
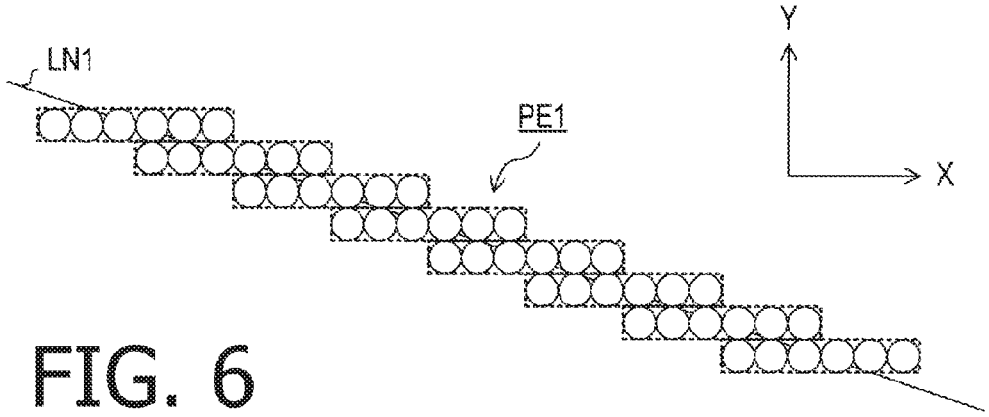

FIG. 6 exemplifies a first pattern element included in each first test pattern in the illustrative embodiment according to one or more aspects of the present disclosure.

Figure 7:
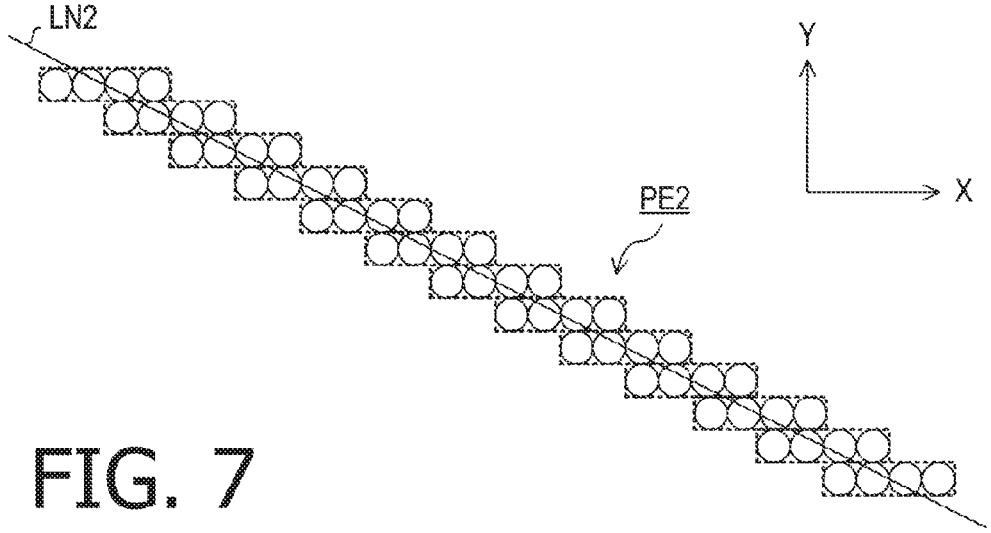

FIG. 7 exemplifies a second pattern element included in each first test pattern in the illustrative embodiment according to one or more aspects of the present disclosure.

Figure 8:
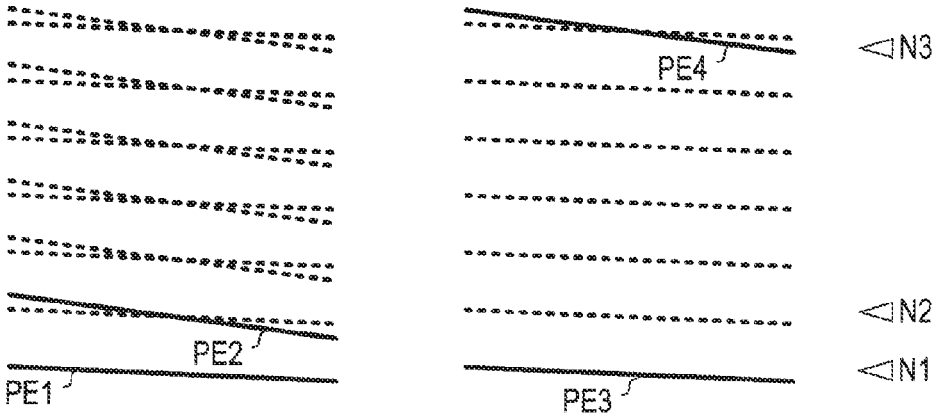

FIG. 8 shows a positional relationship among first to fourth pattern elements (see solid lines) concurrently formed on a sheet and first to third nozzle groups of the recording head in the illustrative embodiment according to one or more aspects of the present disclosure.

Figure 9:
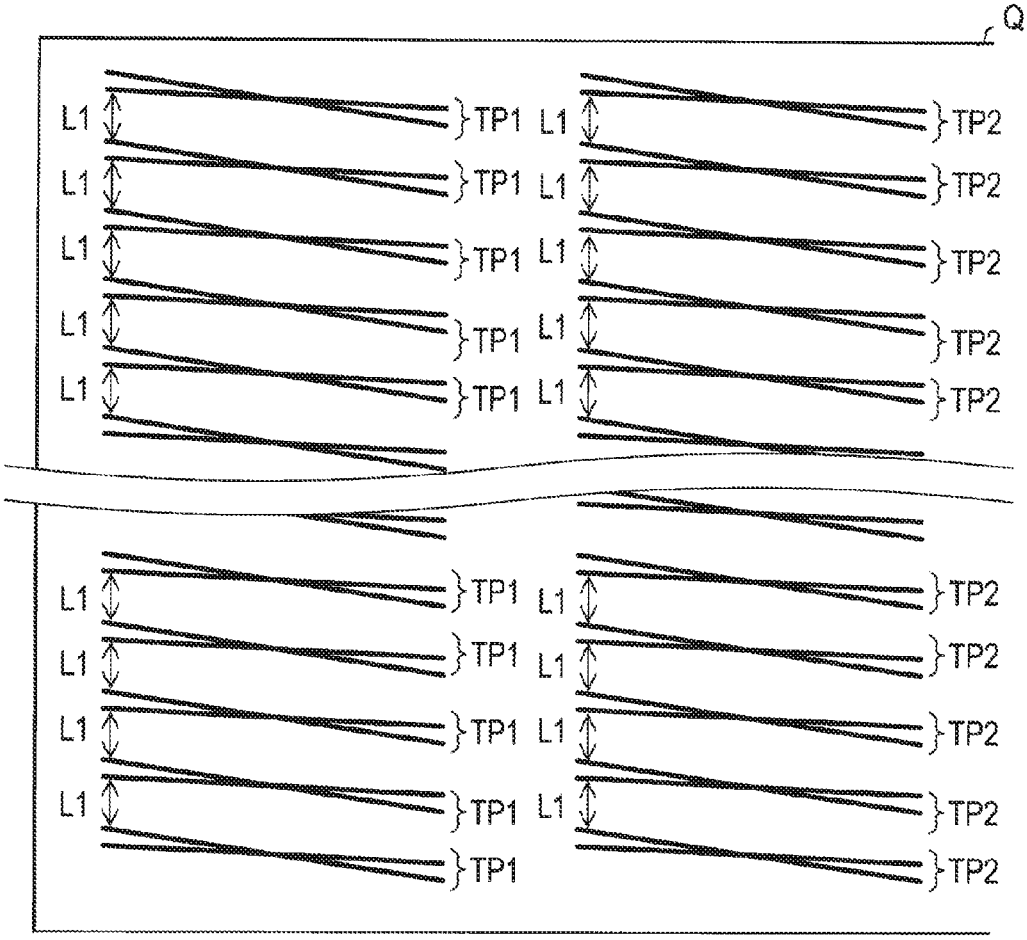

FIG. 9 shows a group of first test patterns and a group of second test patterns formed on the sheet in the illustrative embodiment according to one or more aspects of the present disclosure.

Figure 10:
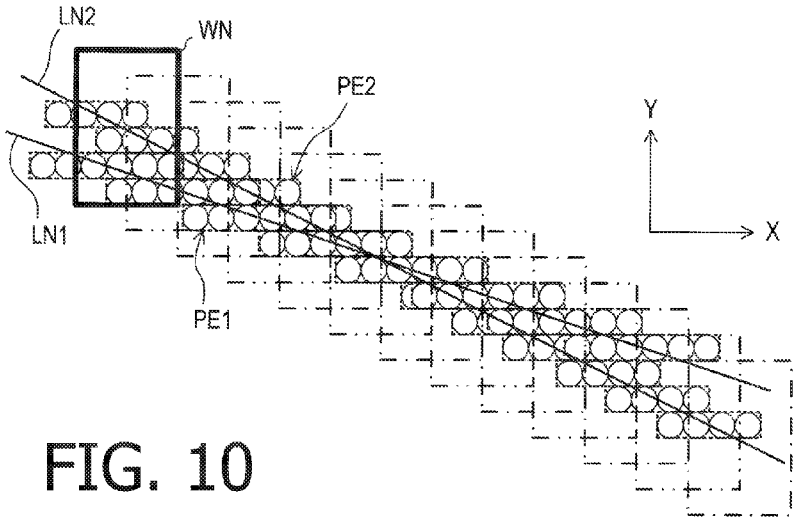

FIG. 10 an illustration for showing how to detect a position of an intersection between the first pattern element and the second pattern element included in a first test pattern in the illustrative embodiment according to one or more aspects of the present disclosure.

Figure 11:
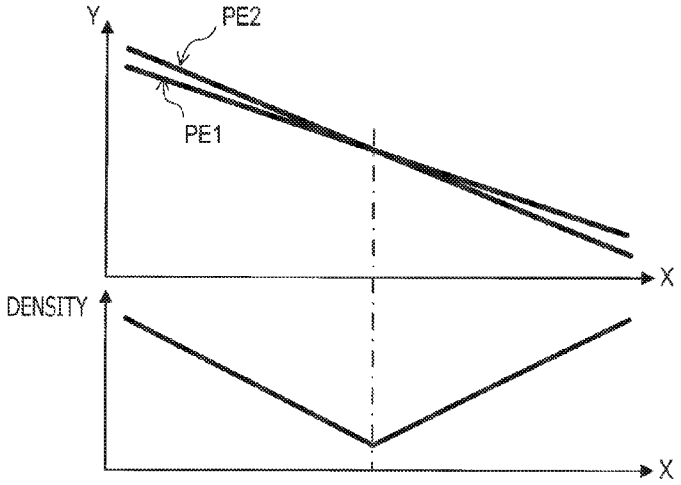

FIG. 11 shows a relationship between a density distribution (i.e., a density change) of the first and second pattern elements in a main scanning direction (i.e., an X-axis direction) and the position of the intersection between the first and second pattern elements in the main scanning direction, in the illustrative embodiment according to one or more aspects of the present disclosure.

Figure 12:
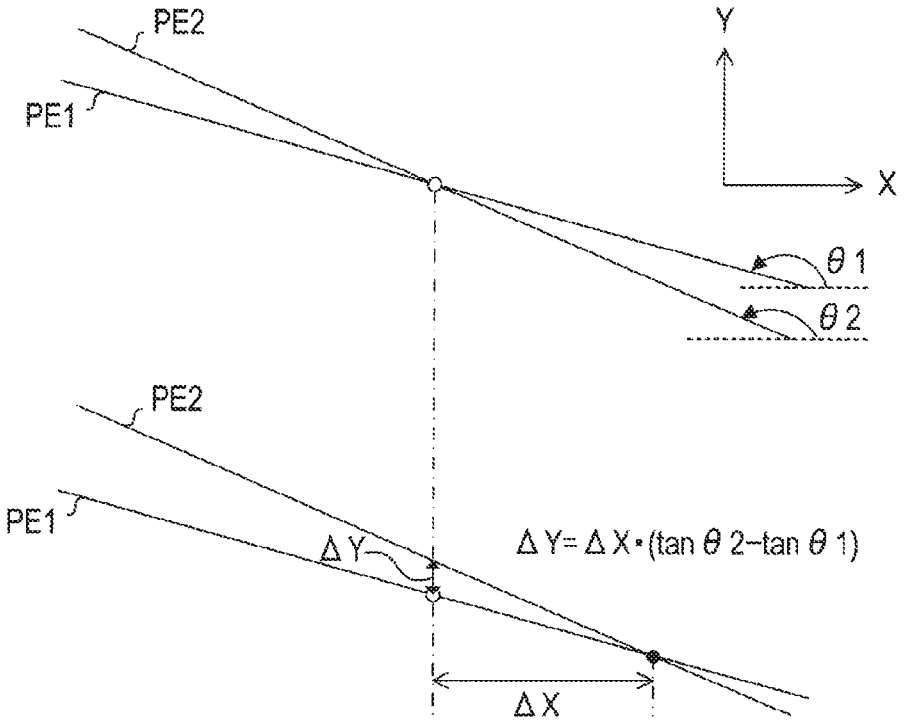

FIG. 12 is an illustration showing a geometrical relationship between a positional displacement of the intersection between the first and second pattern elements in the main scanning direction and a conveyance distance error in a sub scanning direction (i.e., a Y-axis direction), in the illustrative embodiment according to one or more aspects of the present disclosure.

Figure 13:
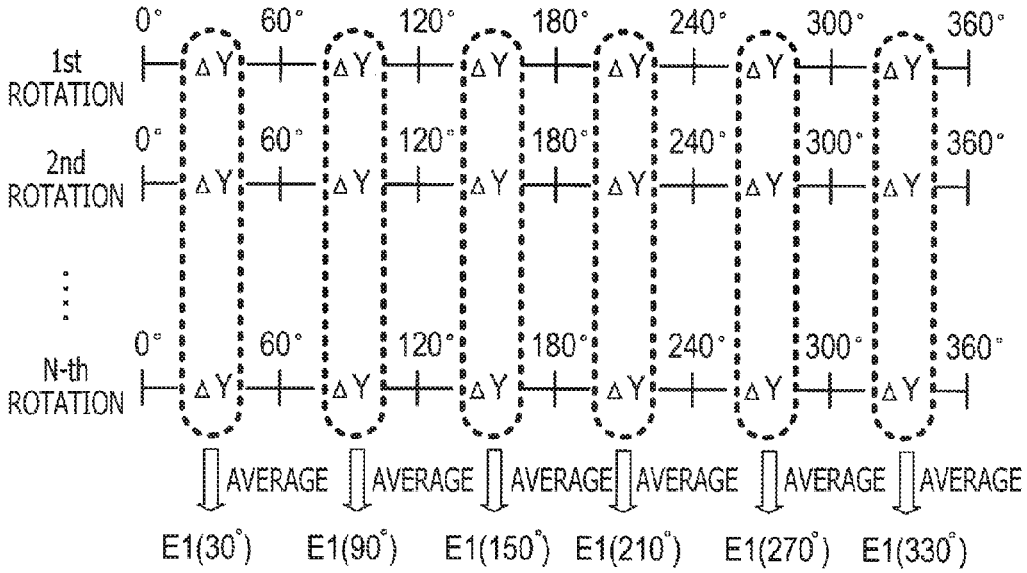

FIG. 13 is an illustration for showing how to calculate periodic components of the conveyance distance error in the illustrative embodiment according to one or more aspects of the present disclosure.

Figure 14:
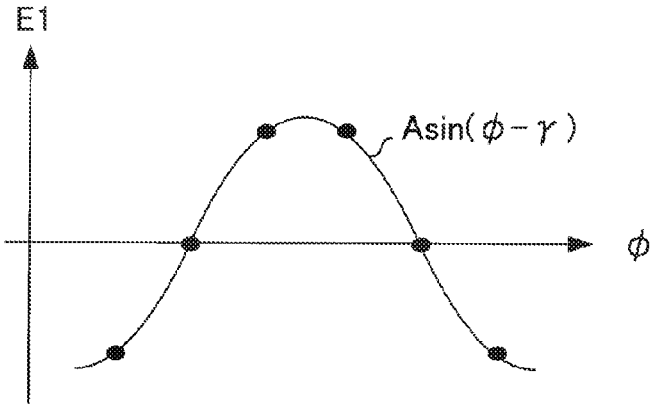

FIG. 14 is an illustration for showing how to fit the periodic components to a sine function in the illustrative embodiment according to one or more aspects of the present disclosure.

Figure 15:
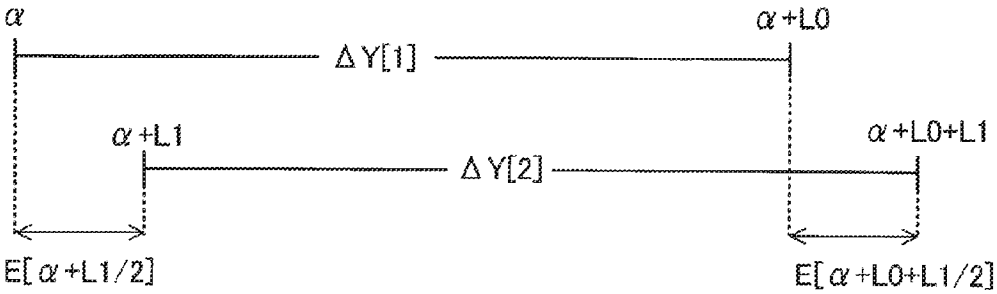
Figure 16:
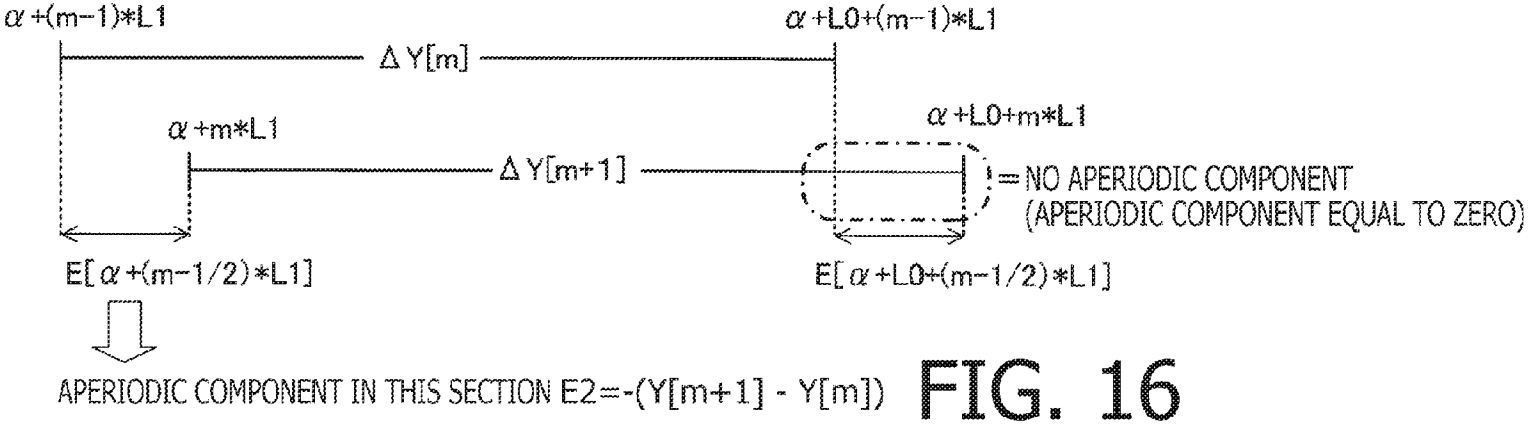

FIGS. 15 and 16 are illustrations for showing how to calculate an aperiodic component of the conveyance distance error in the illustrative embodiment according to one or more aspects of the present disclosure.

Figure 17:
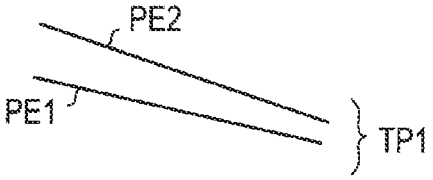

FIG. 17 schematically shows a first test pattern including a first pattern element and a second pattern element formed to be in proximity to but not intersect the first pattern element, in a modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

(Illustrative Embodiment)

Figure 1:
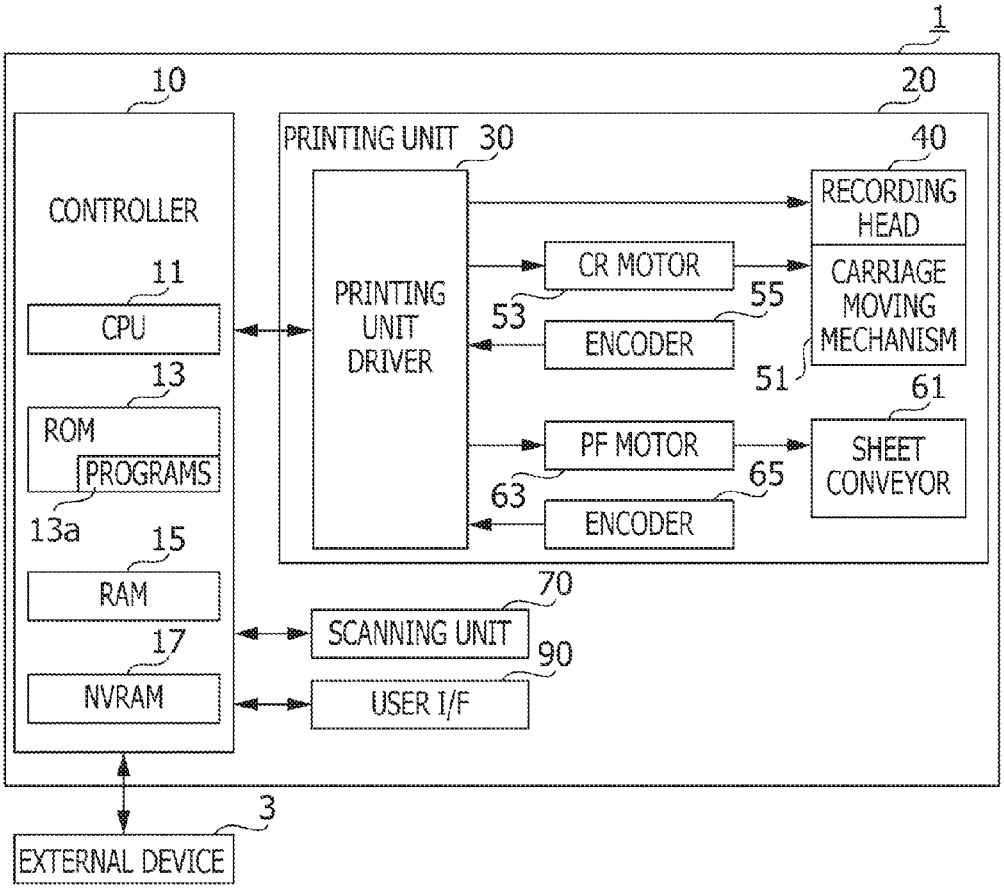

Hereinafter, an illustrative embodiment according to aspects of the present disclosure will be described with reference to the accompanying drawings. As shown in FIG. 1, a digital multi-function peripheral (hereinafter, simply referred to as an "MFP") 1 of the illustrative embodiment includes a controller 10, a printing unit 20, a scanning unit 70, and a user interface 90. The controller 10 is configured to take overall control of the MFP 1 and cause the MFP 1 to serve as a printer, an image scanner, and a copy machine.

The controller 10 includes a CPU 11, a ROM 13, a RAM 15, and an NVRAM 17. The CPU 11 is configured to perform processes in accordance with computer programs 13*a* stored in the ROM 13. The RAM 15 is used as a work area when the CPU 11 is executing a computer program 13*a*. The NVRAM 17 is a non-volatile memory configured to electrically rewrite data stored therein. For instance, the NVRAM 17 may include a flash memory and/or an EEPROM. The controller 10 further includes a communication interface (not shown) configured to communicate with an external device 3.

The printing unit 20 is configured as an inkjet printer. Specifically, the printing unit 20 is configured to, when controlled by the controller 10, form an image on a sheet Q. For instance, the printing unit 20 forms on a sheet Q an image based on data received from the external device 3 or image data representing an image read by the scanning unit 70. Further, the printing unit 20 is configured to, when controlled by the controller 10, form on a sheet Q test patterns for determining a conveyance distance error caused when the sheet Q is conveyed.

The scanning unit 70 is configured as a flatbed scanner. Specifically, the scanning unit 70 is configured to, when controlled by the controller 10, optically scan a document placed on a document table and transmit to the controller 10 image data representing a scanned image of the document. The user interface 90 includes a display configured to display various kinds of information for users, and an input device configured to accept instructions from users. The input device may include mechanical key switches and/or a touch panel on the display.

Subsequently, the printing unit 20 will be described in detail. As shown in FIG. 1, the printing unit 20 includes a printing unit driver 30, a recording head 40, a carriage moving mechanism 51, a CR motor 53, a linear encoder 55, a sheet conveyor 61, a PF motor 63, and a rotary encoder 65.

The printing unit driver 30 is configured to control the recording head 40 to discharge ink droplets, control the carriage moving mechanism 51 to move a carriage 52 (see FIG. 2), and control the sheet conveyor 61 to convey a sheet Q, in accordance with instructions from the controller 10. The printing unit driver 30 may include an ASIC.

The recording head 40 is a known inkjet head. The recording head 40 is configured to, when controlled by the printing unit driver 30, discharge ink droplets thereby forming an image on a sheet Q. The recording head 40 has a lower surface facing the sheet Q, and includes ink discharge nozzles disposed at the lower surface. Specifically, the recording head 40 includes a group N0 of ink discharge nozzles arranged in a sub scanning direction. Hereinafter, the group N0 of ink discharge nozzles may be referred to as a "nozzle group N0." The sub scanning direction corresponds to a sheet conveyance direction and a Y-axis direction shown in FIG. 2.

Figure 2:
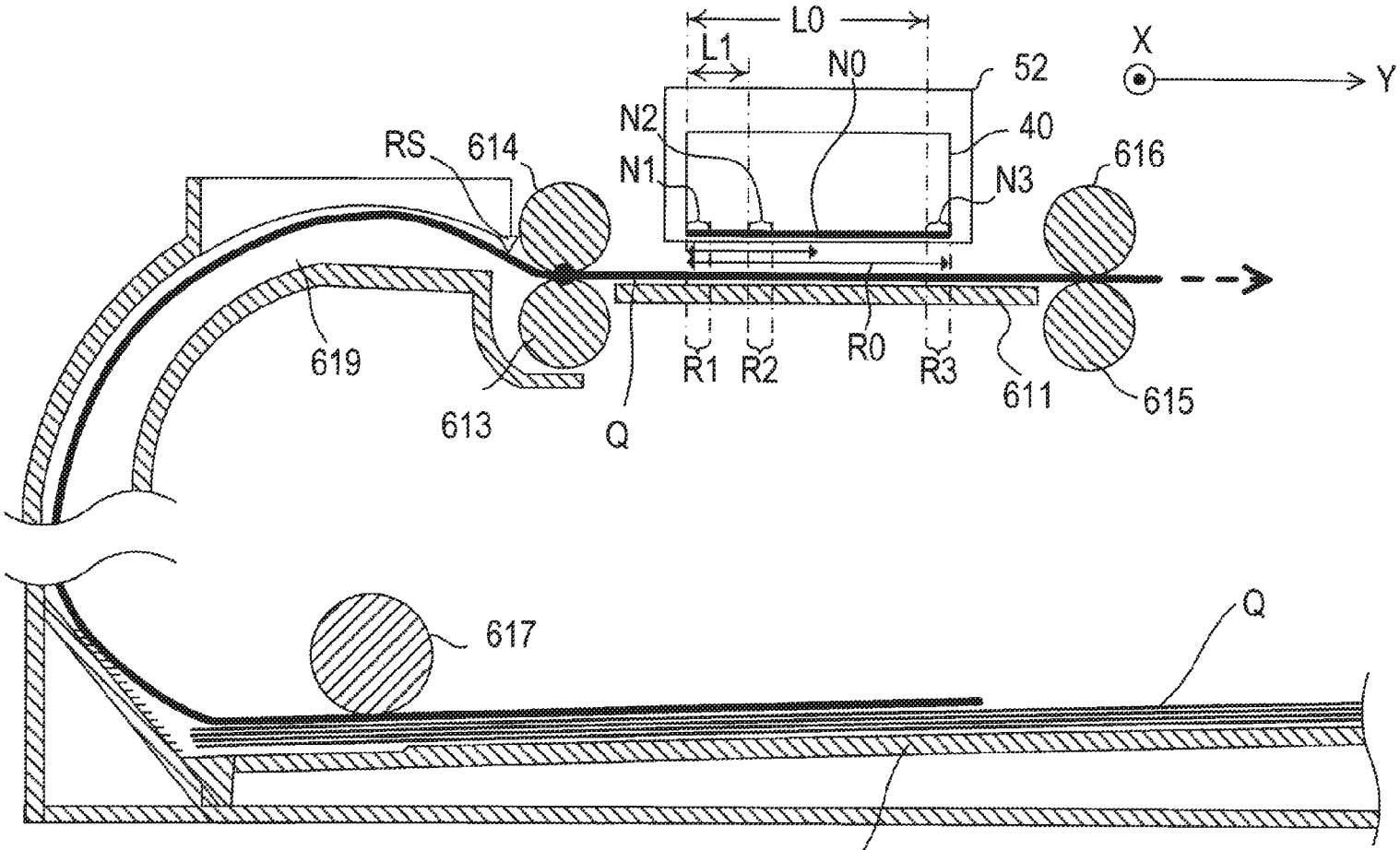

The carriage moving mechanism 51 includes the carriage 52 carrying the recording head 40. The carriage moving mechanism 51 is configured to move the carriage 52 along a main scanning direction. The main scanning direction corresponds to an X-axis direction shown in FIG. 2 and a normal direction of a flat surface on which FIG. 2 is drawn. In the illustrative embodiment, the main scanning direction is perpendicular to the sub scanning direction.

The CR motor 53 includes a direct-current motor for driving the carriage moving mechanism 51. The CR motor 53 is controlled by the printing unit driver 30. Namely, the printing unit driver 30 controls rotation of the CR motor 53 thereby implementing control for moving the carriage 52.

The linear encoder 55 is configured to input pulse signals, which correspond to displacement of the carriage 52 in the main scanning direction, as encoder signals into the printing unit driver 30. The printing unit driver 30 detects a position and a velocity of the carriage 52 in the main scanning direction based on the encoder signals from the linear encoder 55, and performs feedback control of the position and the velocity of the carriage 52. The printing unit driver 30 controls the recording head 40 in accordance with the movement of the carriage 52, and causes the recording head 40 to discharge ink droplets. Thereby, an intended image is formed on the sheet Q.

The sheet conveyor 61 is configured to convey a sheet Q from a feed tray 618 to a discharge tray (not shown) via a recording area R0 in which image formation is performed by the recording head 40. As shown in FIG. 2, the sheet conveyor 61 includes a platen 611 below the recording head 40. Further, the sheet conveyor 61 includes a conveyance roller 613, a pinch roller 614, a discharge roller 615, and a spur roller 616. The conveyance roller 613 and the pinch roller 614 are disposed to face each other in a position upstream of the platen 611 in the sheet conveyance direction. The discharge roller 615 and the spur roller 616 are disposed to face each other in a position downstream of the platen 611 in the sheet conveyance direction.

The conveyance roller 613 and the discharge roller 615 are connected with the PF motor via a transmission mechanism (not shown). In response to receiving a driving force from the PF motor 63, the conveyance roller 613 and the discharge roller 615 rotate in synchronization with each other. The PF motor 63 includes a direct-current motor for driving the sheet conveyor 61.

When a pickup roller 617 rotates, the sheet conveyor 61 separates sheets Q placed on the feed tray 618 on a sheet-by-sheet basis, and sequentially feeds the separated sheets Q between the conveyance roller 613 and the pinch roller 614 via a curved sheet conveyance path 619. When driven to rotate by the PF motor 63, the conveyance roller 613 conveys a sheet Q fed from the feed tray 618 downstream in the sheet conveyance direction as indicated by a dashed arrow in FIG. 2. While pinching the sheet Q with the pinch roller 614, the conveyance roller 613 conveys, by the rotation thereof, the sheet Q downstream in the sheet conveyance direction.

The sheet Q, which is being conveyed downstream in the sheet conveyance direction by the rotation of the conveyance roller 613, passes over the recording area R0 below the recording head 40 while being supported by the platen 611. Then, the sheet Q is conveyed downstream in the sheet conveyance direction by the rotation of the discharge roller 615 while being pinched between the discharge roller 615 and the spur roller 616. After passing between the discharge roller 615 and the spur roller 616, the sheet Q is finally discharged onto the discharge tray (not shown).

The rotary encoder 65 may be disposed at a rotational shaft of the conveyance roller 613 or a rotational shaft of the PF motor 63, or may be disposed on a power transmission path from the PF motor 63 to the conveyance roller 613. The rotary encoder 65 is configured to input pulse signals, which correspond to rotation of the conveyance roller 613, as encoder signals into the printing unit driver 30.

Based on the encoder signals from the rotary encoder 65, the printing unit driver 30 detects a rotation amount, a rotational speed, and a rotational phase $\varphi$ of the conveyance roller 613. The rotational phase $\varphi$ corresponds to a rotational angle $\varphi$ ($0 \leq \varphi < 2\pi$) of the conveyance roller 613 within a range from zero to $2\pi$ when a single rotation of the conveyance roller 613 is expressed as $2\pi$.

The controller 10 stores in the NVRAM 17 control parameters set according to an individual difference of the printing unit 20. The controller 10 appropriately controls the printing unit 20 based on the control parameters. Specifically, on the basis of the control parameters stored in the NVRAM 17, the controller 10 sets, for the printing unit driver 30, specific control parameters that regulate control operations of the printing unit driver 30. Thereby, the controller 10 adapts the control operations of the printing unit driver 30 to the individual difference of the printing unit 20, and appropriately controls the printing unit 20.

Based on the encoder signals from the linear encoder 55 and the rotary encoder 65, the printing unit driver 30 takes control of the CR motor 53 and the PF motor 63 according to control parameters set specifically for the CR motor 53 and the PF motor 63 by the controller 10. In the illustrative embodiment, the controller 10 and the printing unit driver 30 cooperate with each other. Thereby, it is possible to implement ink discharge control for the recording head 40 to discharge ink droplets, carriage moving control for the carriage moving mechanism 51 to move the carriage 52 carrying the recording head 40, and sheet conveyance control for the sheet conveyor 61 to convey the sheets Q.

Specifically, the control parameters stored in the NVRAM 17 include particular control parameters that represent an association between the rotation amount of the conveyance roller 613 and a sheet conveyance distance. For instance, the particular control parameters representing the aforementioned association may be control parameters for specifying a conveyance distance error that is an error from a reference conveyance distance of the sheet Q conveyed by rotation of the conveyance roller 613, and more specifically, is a conveyance distance error in an arbitrary rotational position of the conveyance roller 613 after a leading end of the sheet Q in the sheet conveyance direction reaches the conveyance roller 613.

For instance, the reference conveyance distance may be a conveyance distance of the sheet Q when the conveyance distance is identical to a rotation amount of the conveyance roller 613. For instance, an event that the leading end of the sheet Q in the sheet conveyance direction has reached the conveyance roller 613 is detected based on a detection signal from a registration sensor RS. For instance, the registration sensor RS is disposed in a position, on the sheet conveyance path, close to and upstream of the conveyance roller 613 in the sheet conveyance direction. The registration sensor RS is configured to issue an ON signal to the printing unit driver 30 when detecting the sheet Q, and issue an OFF signal to the printing unit driver 30 when not detecting the sheet Q.

Specifically, the particular control parameters that are stored in the NVRAM 17 and represent the aforementioned association may include parameters for specifying a periodic component and an aperiodic component of the conveyance distance error. In this case, by summing an aperiodic component of the conveyance distance error at each rotation amount of the conveyance roller 613 and a periodic component of the conveyance distance error at each rotational phase φ of the conveyance roller 613, it is possible to previously specify a conveyance distance error in each rotational position of the conveyance roller 613 after the leading end of the sheet Q in the sheet conveyance direction reaches the conveyance roller 613.

Based on the parameters, the controller 10 sets for the printing unit driver 30 specific control parameters adjusted to suppress the conveyance distance error of the sheet Q. For instance, the controller 10 calculates a target rotation amount of the conveyance roller 613 corresponding to a target sheet conveyance distance, in consideration of the conveyance distance error. Then, the controller 10 sets, for the printing unit driver 30, a parameter that represents the calculated target rotation amount of the conveyance roller 613. Thereby, the sheet Q is conveyed by the conveyance roller 613 so as to suppress a periodic conveyance distance error caused by an eccentricity and/or an individual difference in shape of the conveyance roller 613 and an aperiodic conveyance distance error caused by changes of forces applied to the sheet Q. The aperiodic conveyance distance error may be caused by a change of a force applied to the sheet Q due to structural factors of the sheet conveyance path 619. Further, the aperiodic conveyance distance error may be caused by a change of a force applied to the sheet Q when the leading end of the sheet Q in the sheet conveyance direction is brought into an area between the discharge roller 615 and the spur roller 616. Moreover, the aperiodic conveyance distance error may be caused by a change of a force applied to the sheet Q when the trailing end of the sheet Q in the sheet conveyance direction passes through an area between the conveyance roller 613 and the pinch roller 614.

The controller 10 corrects the particular control parameters that represent the association between the rotation amount of the conveyance roller 613 and the sheet conveyance distance, among the control parameters stored in the NVRAM 17, based on a result of test pattern formation. The particular control parameters are initially set to standard values that are determined without considering the individual difference of the printing unit 20, and are updated to values according to the individual difference of the printing unit 20, based on the result of test pattern formation.

Figure 3A:
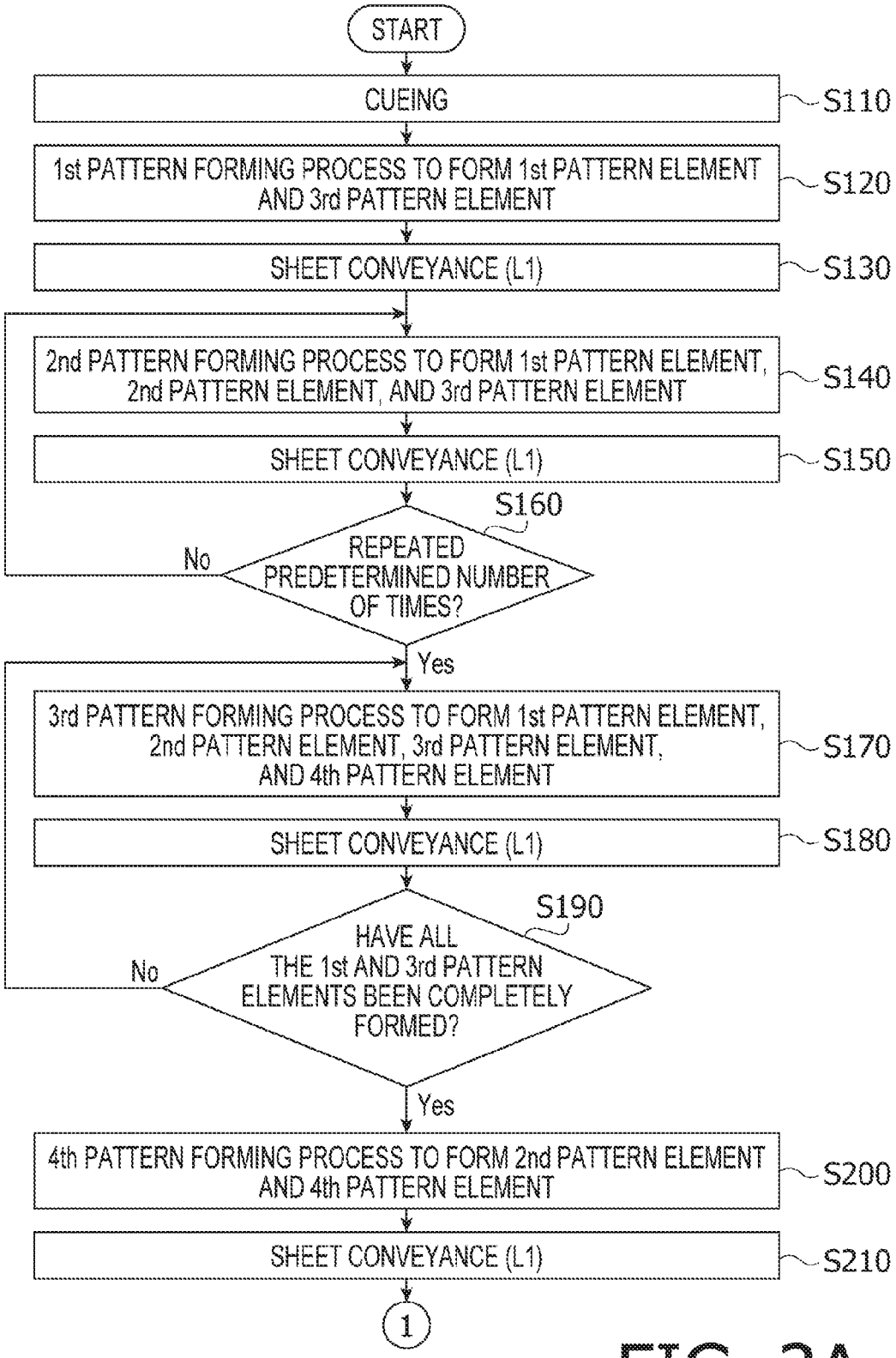
FIGS. 3A and 3B are flowcharts showing a procedure of a test printing process to be executed by a controller of the MFP in the illustrative embodiment according to one or more aspects of the present disclosure.
Figure 3B:
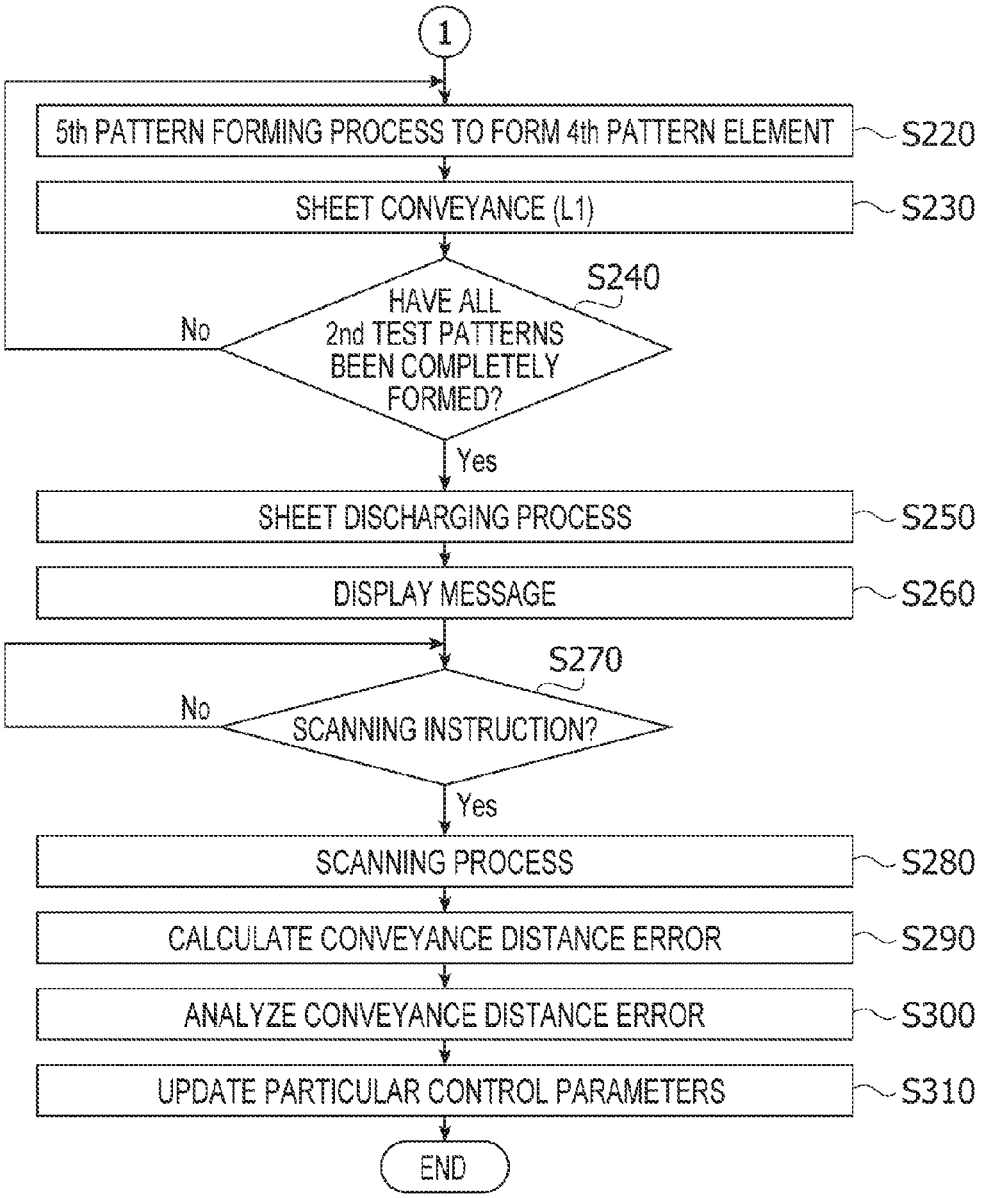

When receiving an instruction to print test patterns via the user interface 90 or from the external device 3, the controller 10 performs a test printing process shown in FIGS. 3A and 3B in accordance with one or more programs 13*a* stored in the ROM 13. For instance, when a user of the MFP 1 or an operator of a manufacturer of the MFP 1 operates the user interface 90 or the external device 3, the instruction to print test patterns is issued.

When the test printing process is started, the controller 10 causes the printing unit driver 30 to control the PF motor 63 thereby causing the sheet conveyor 61 to convey a leading end of a sheet Q in the sheet conveyance direction to an upstream end section of the recording area R0 below the recording head 40 in the sheet conveyance direction (S110: Cueing).

Figures 4A, 4B, 4C, 4D, 4E:
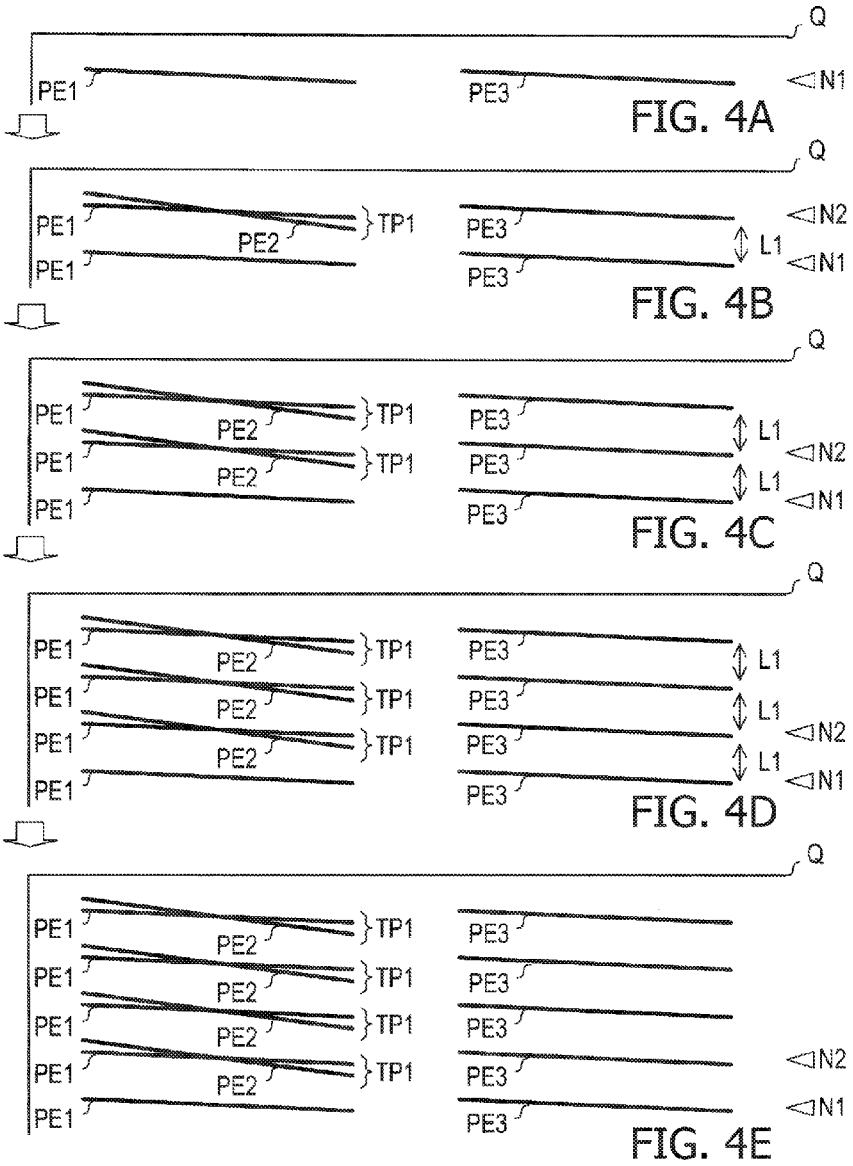
FIGS. 4A to 4E and 5A to 5C show a process in which test patterns are printed on a step-by-step basis in the illustrative embodiment according to one or more aspects of the present disclosure.

Then, the controller 10 performs a first forming process (S120). In the first forming process, the controller 10 controls, via the printing unit driver 30, the recording head 40 to discharge ink droplets from a first nozzle group N1 and form a first pattern element PE1 and a third pattern element PE3 on a portion of the sheet Q that is positioned in a first recording area R1 (S120). FIG. 4A schematically shows the first pattern element PE1 and the third pattern element PE3 formed on the sheet Q in the first forming process.

The first recording area R1 corresponds to a partial area of the recording area R0 that is positioned under the first nozzle group N1. In other words, the first recording area R1 is an area of the recording area R0 where the recording head 40 is allowed to perform image formation using the first nozzle group N1. The first nozzle group N1 corresponds to a group of nozzles included in the nozzle group N0 that are positioned upstream of the other nozzles included in the nozzle group N0 in the sheet conveyance direction.

In the first forming process, the printing unit driver 30 controls the CR motor 53 in a state where the sheet Q is stopped, thereby moving the carriage 52 in the main scanning direction. Further, the printing unit driver 30 performs ink discharge control of the recording head 40 that is moving in the main scanning direction along with the carriage 52. Thereby, while moving in the main scanning direction, the recording head 40 discharges ink droplets from the first nozzle group N1 to form the first pattern element PE1 on the sheet Q and further form the third pattern element PE3 in a position away from the first pattern element PE1 in the main scanning direction. Thus, in the first forming process, the first pattern element PE1 and the third pattern element PE3 are formed in respective different positions in the main scanning direction.

The first pattern element PE1 formed on the sheet Q is a figure element formed macroscopically or approximately in the shape of a straight line slightly inclined relative to the main scanning direction. Specifically, the first pattern element PE1 has a geometrical pattern shown in FIG. 6. Each white circle shown in FIG. 6 represents a dot. Each dot row surrounded by a dashed line is formed approximately in a rectangular shape. A straight line LN1 shown in FIG. 6 is a virtual straight line. It is noted that the virtual straight line LN1 and the dashed lines surrounding the dot rows are not printed on the sheet Q.

Specifically, the first pattern element PE1 shown in FIG. 4A is formed with a plurality of dot rows, each having a plurality of dots arranged in the main scanning direction, being arranged in a terraced manner along the virtual straight line LN1, as shown in FIG. 6. FIG. 6 shows an example in which each dot row has six dots. Nonetheless, the number of dots is not limited to six. Thus, the first pattern element PE1 is macroscopically formed in a straight line having a uniform width and inclined relative to the main scanning direction. In FIG. 6, an X-axis direction and a Y-axis direction may be understood as corresponding to the X-axis direction and the Y-axis direction shown in FIG. 2. In other words, in FIG. 6, the X-axis direction corresponds to the main scanning direction, and the Y-axis direction corresponds to the sub scanning direction.

According to the illustrative embodiment, the third pattern element PE3 has the same geometrical pattern as the first pattern element PE1. Nonetheless, the third pattern element PE3 may not necessarily have the same geometrical pattern as the first pattern element PE1.

After the first pattern element PE1 and the third pattern element PE3 have been formed in the first forming process, the controller 10 controls, via the printing unit driver 30, the PF motor 63 to cause the sheet conveyor 61 to rotate the conveyance roller 613 by a particular amount L1, thereby conveying the sheet Q over the particular amount L1 downstream in the sheet conveyance direction (S130). The process of conveying the sheet Q over the particular amount L1 is carried out by rotation control of the conveyance roller 613. Therefore, an actual sheet conveyance distance contains an error relative to the particular amount L1.

Afterward, the controller 10 performs a second forming process in a state where the sheet Q is stopped (S140). In the second forming process, the controller 10 controls, via the printing unit driver 30, the recording head 40 to discharge ink droplets from the first nozzle group N1 and form a first pattern element PE1 and a third pattern element PE3 on a portion of the sheet Q that is positioned in the first recording area R1, in the same manner as executed in the first forming process. Further, the controller 10 controls, via the printing unit driver 30, the recording head 40 to discharge ink droplets from a second nozzle group N2 and form a second pattern element PE2 on a portion of the sheet Q that is positioned in a second recording area R2 into which the first pattern element PE1 has been conveyed and placed (see FIG. 4B).

The second recording area R2 corresponds to a partial area of the recording area R0 that is positioned under the second nozzle group N2. In other words, the second recording area R2 is an area of the recording area R0 where the recording head 40 is allowed to perform image formation using the second nozzle group N2. Among the nozzle group N0, the second nozzle group N2 is positioned the particular amount L1 downstream of the first nozzle group N1 in the sheet conveyance direction. In other words, a distance between an upstream end of the first nozzle group N1 and an upstream end of the second nozzle group N2 in the sub scanning direction is equal to the particular amount L1.

FIG. 4B schematically shows the first pattern element PE1, the second pattern element PE2, and the third pattern element PE3 formed on the sheet Q in the second forming process. The pattern elements PE1, PE2, and PE3, which are shown in FIG. 4B in addition to the pattern elements PE1 and PE3 shown in FIG. 4A, are the pattern elements PE1, PE2, and PE3 formed on the sheet Q in the second forming process.

Reference characters "N1" and "N2" shown at a right end of FIGS. 4A to 4E indicate the positions of the nozzle groups N1 and N2 in the sub scanning direction (i.e., the vertical directions in the figures), respectively. The recording head 40 is unmovable in the sub scanning direction. Therefore, the positions of the nozzle groups N1 and N2 are fixed in the sub scanning direction on the sheet conveyance path.

In S130, the pattern elements PE1 and PE3 formed on the sheet Q in the first forming process are conveyed in the sub scanning direction along with the sheet Q over a distance corresponding to the rotation amount L1 of the conveyance roller 613. At this time, when the conveyance distance error is negligibly small, the sheet conveyance distance is substantially equal to the particular amount L1. Accordingly, in FIG. 4B showing a pattern-formed state on the sheet Q after the second forming process is performed in S140, the pattern elements PE1 and PE3 formed in the first forming process are in a position corresponding to the second nozzle group N2 that is the particular amount L1 away from the first nozzle group N1 in the sub scanning direction. Therefore, in the second forming process, the second pattern element PE2 is formed to intersect the first pattern element PE1 that has been conveyed over the distance corresponding to the particular amount L1 in the sheet conveyance direction since the same first pattern element PE1 was formed on the sheet Q.

The second pattern element PE2 shown in FIG. 4B is formed macroscopically or approximately in the shape of a straight line slightly inclined relative to each of the main scanning direction and the first pattern element PE1. As exemplified in FIG. 4B, the second pattern element PE2 is formed to intersect the first pattern element PE1. Thus, in the illustrative embodiment, a first test pattern TP1 is formed as a combination (or a pair) of the first pattern element PE1 and the second pattern element PE2. In the illustrative embodiment, a conveyance distance error of the sheet Q conveyed by the conveyance roller 613 rotating by the particular amount L1 is calculated based on a positional relationship between the first pattern element PE1 and the second pattern element PE2. A detailed explanation will be provided later about how to determine the conveyance distance error.

Specifically, the second pattern element PE2 has a geometrical pattern shown in FIG. 7. In the same manner as shown in FIG. 6, each white circle shown in FIG. 7 represents a dot. In FIG. 7, an X-axis direction corresponds to the main scanning direction, and a Y-axis direction corresponds to the sub scanning direction. Further, a straight line LN2 shown in FIG. 7 is a virtual straight line. It is noted that the virtual straight line LN2 and dashed lines surrounding dot rows are not actually printed on the sheet Q.

Specifically, the second pattern element PE2 shown in FIG. 4B is formed with a plurality of dot rows, each having a plurality of dots arranged in the main scanning direction, being arranged in a terraced manner along the virtual straight line LN2, as shown in FIG. 7. FIG. 7 shows an example in which each dot row has four dots. Nonetheless, the number of dots is not limited to four. Thus, the second pattern element PE2 is macroscopically formed in a straight line having a uniform width and inclined relative to each of the main scanning direction and the first pattern element PE1.

In the second forming process, the printing unit driver 30 controls the CR motor 53 in a state where the sheet Q is stopped, thereby moving the carriage 52 in the main scanning direction. Further, the printing unit driver 30 performs ink discharge control of the recording head 40 that is moving in the main scanning direction along with the carriage 52. Thereby, while moving in the main scanning direction, the recording head 40 discharges ink droplets from each of the first nozzle group N1 and the second nozzle group N2, thereby concurrently forming the first pattern element PE1 and the second pattern element PE2 on the sheet Q. Further, after the carriage 52 moves over a predetermined distance in the main scanning direction, the recording head 40 discharges ink droplets from a third nozzle group N3, thereby forming the third pattern element PE3 on the sheet Q. Thus, in the second forming process, in the same manner as performed in the first forming process, the first pattern element PE1 and the third pattern element PE3 are formed in mutually different positions in the main scanning direction on the sheet Q. Further, the second pattern element PE2 is formed in a position corresponding to the first pattern element PE1 in the main scanning direction on the sheet Q.

It is noted that the first pattern element PE1, the second pattern element PE2, and the third pattern element PE3 may be formed while the carriage 52 is moving in a single direction along the main scanning direction, and may be formed while the carriage 52 is reciprocatingly moving in both directions along the main scanning direction. For instance, the first pattern element PE1 and the second pattern element PE2 may be formed while the carriage 52 is moving in one of the two directions along the main scanning direction, whereas the third pattern element PE3 may be formed while the carriage 52 is moving in the other direction along the main scanning direction.

Afterward, in the same manner as executed in S130, the controller 10 controls, via the printing unit driver 30, the sheet conveyor 61 to rotate the conveyance roller 613 by the particular amount L1, thereby conveying the sheet Q over the particular amount L1 downstream in the sheet conveyance direction (S150).

After executing the steps S140 and S150 repeatedly a predetermined number of times (S160: Yes), the controller 10 goes to S170. By executing the steps S140 and S150 repeatedly the predetermined number of times, the third pattern element PE3 formed in the first forming process is placed into a third recording area R3.

As shown in FIG. 2, the third recording area R3 corresponds to a partial area of the recording area R0 that is positioned under the third nozzle group N3. In other words, the third recording area R3 is an area of the recording area R0 where the recording head 40 is allowed to perform image formation using the third nozzle group N3. Among the nozzle group N0, the second nozzle group N3 is positioned a distance L0 downstream of the first nozzle group N1 in the sheet conveyance direction. In other words, a distance between the upstream end of the first nozzle group N1 and an upstream end of the third nozzle group N3 in the sub scanning direction is equal to the distance L0. The distance L0 is K times as long as the particular amount. K is an integer equal to or more than two, and preferably may be an integer equal to or more than three. Accordingly, when the steps S140 and S150 are executed repeatedly (K−1) times, the third pattern element PE3 formed in the first forming process is conveyed over about the distance L0 (L0=K×L1) and is placed into the third recording area R3.

Figure 5A:
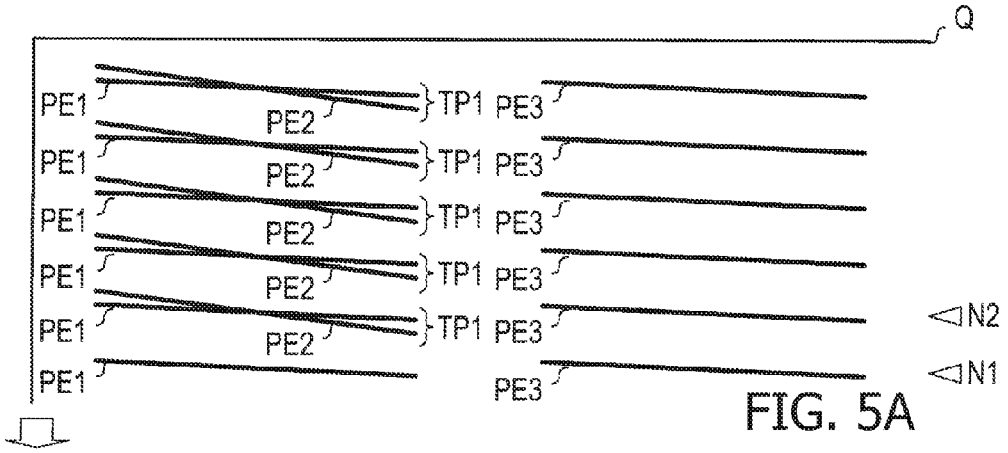

FIG. 4C shows a pattern-formed state on the sheet Q after the second forming process (S140) has been performed twice. Likewise, FIGS. 4D and 4E show pattern-formed states on the sheet Q after the second forming process has been performed repeatedly three times and four times, respectively. FIG. 5A shows a pattern-formed state on the sheet Q after the second forming process has been performed repeatedly five times. According to the example shown in FIGS. 4A to 4E and 5A to 5C, K is equal to six (i.e., K=6). In this case, the controller 10 goes to S170 after executing the steps S140 and S150 repeatedly five times.

In S170, the controller 10 performs a third forming process. In the third forming process, the controller 10 controls, via the printing unit driver 30, the recording head 40 to discharge ink droplets from the first nozzle group N1 and form a first pattern element PE1 and a third pattern element PE3 on the sheet Q. In addition, the controller 10 controls, via the printing unit driver 30, the recording head 40 to discharge ink droplets from the second nozzle group N2 and form a second pattern element PE2 on the sheet Q. Further, the controller 10 controls, via the printing unit driver 30, the recording head 40 to discharge ink droplets from the third nozzle group N3 and form a fourth pattern element PE4 on a portion of the sheet Q that is positioned in the third recording area R3 into which the third pattern element PE3 has been conveyed and placed (see FIG. 5B).

Figure 5B:
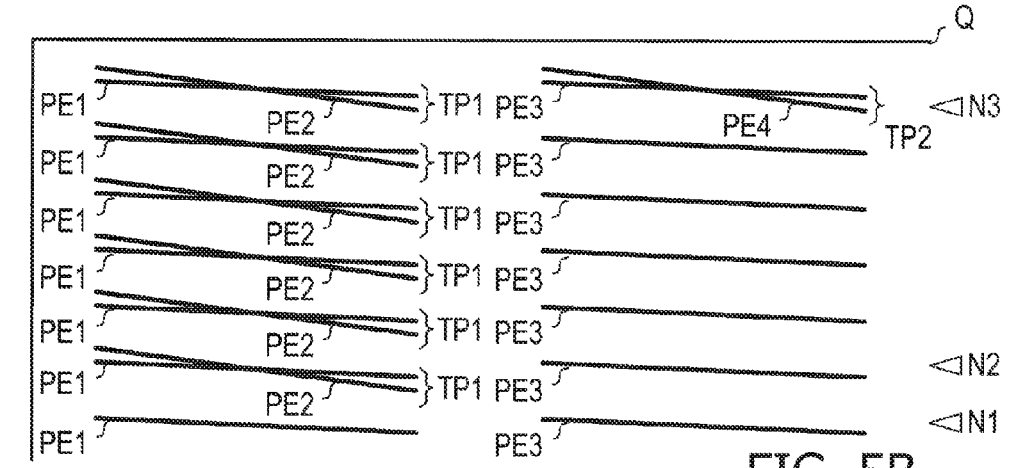
Figure 5C:
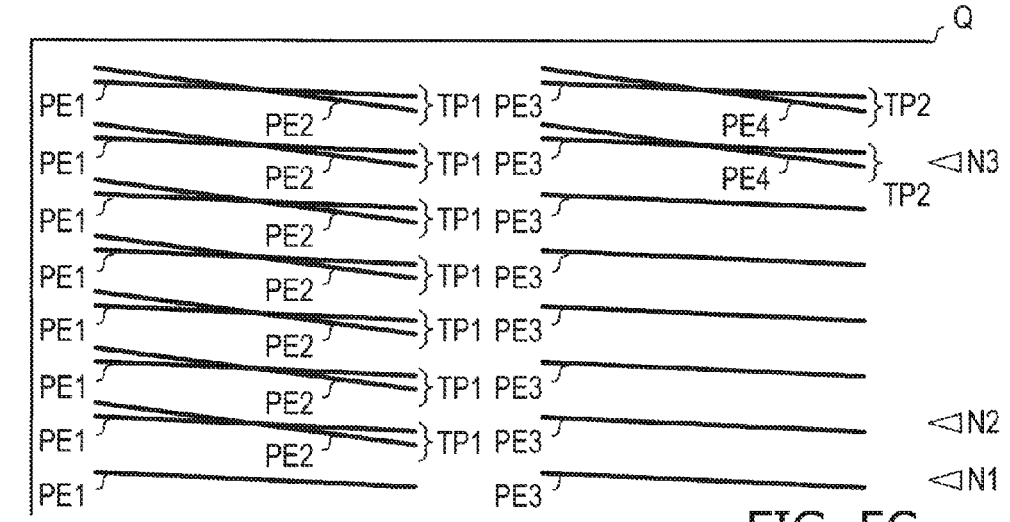

FIG. 5B shows a pattern-formed state on the sheet Q after the third forming process has been performed. In the third forming process, in addition to the already-formed pattern elements indicated by dashed lines in FIG. 8, pattern elements PE1, PE2, PE3, and PE4 indicated by solid lines in FIG. 8 are formed. Reference characters "N1," "N2," and "N3" shown at a right end of FIGS. 5A to 5C and 8 indicate the positions of the nozzle groups N1, N2, and N3 in the sub scanning direction (i.e., the vertical directions in the figures), respectively.

As described above, the pattern elements PE1 and PE3 are formed on the sheet Q with the first nozzle group N1 each time the conveyance roller 613 rotates by the particular amount L1. Namely, the first pattern elements PE1 are formed on the sheet Q at intervals of a distance corresponding to the particular amount L1 by which the conveyance roller 613 rotates, in the sub scanning direction. Likewise, the third pattern elements PE3 are formed on the sheet Q at intervals of the distance corresponding to the particular amount L1 in the sub scanning direction. In other words, if the conveyance distance error is negligibly small, the first pattern elements PE1 are formed on the sheet Q at regular intervals of the particular amount L1 in the sub scanning direction. Likewise, the third pattern elements PE3 are formed on the sheet Q at regular intervals of the particular amount L1 in the sub scanning direction.

Accordingly, when the rotation of the conveyance roller 613 by the particular amount L1 has been repeated K times since the third pattern element PE3 was formed on the sheet Q, the third pattern element PE3 is placed into the third recording area R3. Thus, in the third forming process, the fourth pattern element PE4 is formed to intersect the third pattern element PE3 that has been conveyed over about a distance corresponding to the distance L0 (L0=L1×K) in the sheet conveyance direction since the same third pattern element PE3 was formed on the sheet Q.

In the illustrative embodiment, the fourth pattern element PE4 shown in FIG. 5B has the same geometrical pattern as the second pattern element PE2. Namely, the fourth pattern element PE4 is macroscopically formed in a straight line inclined relative to each of the main scanning direction and the third pattern element PE3.

According to the example shown in FIG. 5B, the fourth pattern element PE4 is formed to intersect the third pattern element PE3. In the illustrative embodiment, it is possible to detect a conveyance distance error of the sheet Q conveyed by the conveyance roller 613 rotating by the distance L0, based on a positional relationship (e.g., a position of an intersection) between the fourth pattern element PE4 and the third pattern element PE3.

In the illustrative embodiment, the distance L0 is equal to an outer circumferential length of the conveyance roller 613. Namely, the distance L0 corresponds to a rotation amount of the conveyance roller 613 that makes a single rotation. Therefore, a test pattern TP2, which is formed as a combination (or a pair) of the third pattern element PE3 and the fourth pattern element PE4, is used to detect an aperiodic component of the conveyance distance error of the sheet Q.

From the aforementioned first test pattern TP1, it is possible to detect a conveyance distance error caused when the conveyance roller 613 rotates by 1/K of the outer circumferential length thereof. Therefore, the first test pattern TP1 is used to detect a periodic component. When K=6, from a group of the first test patterns TP1, a conveyance distance error caused when the conveyance roller 613 rotates by an angle of 60 degrees is obtained every 60-degree angle, which corresponds to the formation interval of the first test patterns TP1. Further, from a group of the second test patterns TP2, a conveyance distance error caused when the conveyance roller 613 rotates by an angle of 360 degrees is obtained every 60-degree angle, which corresponds to a phase interval for forming the second test patterns TP2.

In the third forming process, specifically, the printing unit driver 30 controls the CR motor 53 in a state where conveyance of the sheet Q is stopped, thereby moving the carriage 52 in the main scanning direction. Further, the printing unit driver 30 performs ink discharge control of the recording head 40 that is moving in the main scanning direction along with the carriage 52. Thereby, while moving in the main scanning direction, the recording head 40 discharges ink droplets from each of the first nozzle group N1 and the second nozzle group N2, thereby concurrently forming the first pattern element PE1 and the second pattern element PE2 on the sheet Q. Further, the recording head 40 discharges ink droplets from each of the first nozzle group N1 and the third nozzle group N3, thereby concurrently forming the third pattern element PE3 and the fourth pattern element PE4 on the sheet Q. Thus, in the third forming process, the first pattern element PE1 and the third pattern element PE3 are formed in mutually different positions in the main scanning direction on the sheet Q, in the same manner as executed in the first forming process and the second forming process. Further, the second pattern element PE2 is formed in a position corresponding to the first pattern element PE1. The fourth pattern element PE4 is formed in a position corresponding to the third pattern element PE3. It is noted that the first pattern element PE1, the second pattern element PE2, the third pattern element PE3, and the fourth pattern element PE4 may be formed while the carriage 52 is moving in a single direction along the main scanning direction, and may be formed while the carriage 52 is reciprocatingly moving in both directions along the main scanning direction.

Thereafter, in the same manner as executed in S130, the controller 10 controls, via the printing unit driver 30, the sheet conveyor 61 to rotate the conveyance roller 613 by the particular amount L1, thereby conveying the sheet Q over the particular amount L1 downstream in the sheet conveyance direction (S180).

The controller 10 repeatedly executes the steps S170 and S180 until a terminal end of a target area on the sheet Q where test patterns are to be formed passes through the first recording area R1 (i.e., until all the first and third pattern elements PE1 and PE3 are completely formed) (S190). Then, when all the first and third pattern elements PE1 and PE3 have been completely formed (S190: Yes), the controller 10 goes to S200.

In S200, the controller 10 performs a fourth forming process. In the fourth forming process, the controller 10 controls, via the printing unit driver 30, the recording head 40 to form a second pattern element PE2 and a fourth pattern element PE4 on the sheet Q. The fourth forming process is the same as the third forming process except for the controller 10 controlling the recording head 40 not to form a first pattern element PE1 or a third pattern element PE3. In S210, the controller 10 performs the same process as executed in S130, thereby conveying the sheet Q over the particular amount L1 downstream in the sheet conveyance direction.

Afterward, the controller 10 performs a fifth forming process (S220). In the fifth forming process, the controller 10 controls the recording head 40 to form a fourth pattern element PE4 on the sheet Q. The fifth forming process is the same as the fourth forming process except for the controller 10 controlling the recording head 40 not to form a second pattern element PE2 on the sheet Q. In S230, the controller 10 performs the same process as executed in S130, thereby conveying the sheet Q over the particular amount L1 downstream in the sheet conveyance direction.

The controller 10 repeatedly executes the steps S220 and S230 until the fourth pattern element PE4 is formed with respect to each of all the third pattern elements PE3 formed on the sheet Q (i.e., until all the second test patterns TP2 are completely formed) (S240: No). Then, when all the second test patterns TP2 have been completely formed (S240: Yes), the controller 10 goes to S250. In S250, the controller 10 performs a sheet discharging process.

In the sheet discharging process (S250), the controller 10 controls, via the printing unit driver 30, the sheet conveyor 61 to convey and discharge the sheet Q onto the discharge tray (not shown). Thereby, as shown in FIG. 9, the sheet Q discharged onto the discharge tray has, in a range from the leading end to the trailing end thereof in the sheet conveyance direction (i.e., the sub scanning direction), a group of the first test patterns TP1 arranged at regular intervals along the sub scanning direction and a group of the second test patterns TP2 arranged at regular intervals along the sub scanning direction in parallel with the first test patterns TP1. Hereinafter, the sheet Q to be discharged onto the discharge tray with the test patterns TP1 and TP2 formed thereon may be referred to as a "test-pattern-formed sheet."

Thereafter, the controller 10 displays, on the display of the user interface 90, a message that prompts the user to place the test-pattern-formed sheet on the document table of the scanning unit 70 and input a scan instruction (S260). Then, the controller 10 waits until a scan instruction is input via the user interface 90 (S270).

When a scan instruction is input, the controller 10 controls the scanning unit 70 to scan the test-pattern-formed sheet, and acquires image data representing a scanned image from the scanning unit 70 (S280). Afterward, based on the image data acquired from the scanning unit 70, the controller 10 calculates a conveyance distance error of the sheet Q from each of the first test patterns TP1 and the second test patterns TP2 (S290). Then, by analyzing the conveyance distance errors calculated from the first test patterns TP1 and the second test patterns TP2, the controller 10 detects periodic components and aperiodic components of the conveyance distance errors (S300). Then, based on the detected periodic components and the detected aperiodic components, the controller 10 updates the control parameters stored in the NVRAM 17 (S310). Thereafter, the controller 10 terminates the test printing process shown in FIGS. 3A and 3B.

An explanation will be provided of how to calculate the conveyance distance error from each of the first test patterns TP1 and the second test patterns TP2 in S290. In S290, the controller 10 calculates the conveyance distance error of the sheet Q when each of the first test patterns TP1 and the second test patterns TP2 has been formed, by performing the following processes.

With respect to each of the first test patterns TP1, based on the position of the intersection between the first pattern element PE1 and the second pattern element PE2, the controller 10 calculates a conveyance distance error from a reference conveyance distance (i.e., the particular amount L1) of the sheet Q to be conveyed when the conveyance roller 613 rotates by a rotation amount (i.e., the particular amount L1) during a period from when the first pattern element PE1 is formed to when the second pattern element PE2 is formed. With respect to each of the second test patterns TP2, based on the position of the intersection between the third pattern element PE3 and the fourth pattern element PE4, the controller 10 calculates a conveyance distance error from a reference conveyance distance (i.e., the distance L0) of the sheet Q to be conveyed when the conveyance roller 613 rotates by a rotation amount (i.e., the distance L0) during a period from when the third pattern element PE3 is formed to when the fourth pattern element PE4 is formed.

As an example, the controller 10 may calculate the position of the intersection between the first pattern element PE1 and the second pattern element PE2 in the following method. That is, the controller 10 slides a position of a rectangular window WN (indicated by a solid line in FIG. 10) along the first pattern element PE1 of the image data on a step-by-step basis of a predetermined amount (as indicated by alternate long and short dash lines). Then, the controller 10 calculates a density (e.g., a total area of the pattern elements PE1 and PE2 per a particular area of the rectangular window WN) within the rectangular window WN in each position of the rectangular window WN.

As the total area of the pattern elements PE1 and PE2 included in the rectangular window WN becomes smaller, the density becomes lower. Accordingly, as exemplified in FIG. 11, a change of the density (hereinafter, which may be referred to as a "density distribution") along the first pattern element PE1 is likely to have a local minimum value at the intersection between the first pattern element PE1 and the second pattern element PE2. Thus, based on the density distribution, the controller 10 may identify a position (an X-coordinate) in the main scanning direction where the density distribution along the first pattern element PE1 has the local minimum value, as a position of the intersection between the first pattern element PE1 and the second pattern element PE2.

From the identified position (the X-coordinate) of the intersection in the main scanning direction, the controller 10 may calculate a conveyance distance error in the following method. The controller 10 may calculate a positional displacement ΔX of the identified position of the intersection from a reference point in the main scanning direction (i.e., the X-axis direction). The reference point corresponds to a position of the intersection between the first pattern element PE1 and the second pattern element PE2 when the conveyance distance error of the sheet Q is zero. Positional information of the reference point may be stored in the NVRAM 17.

In an upper area of FIG. 12, a white circle indicates an intersection between the first pattern element PE1 and the second pattern element PE2 when the conveyance distance error of the sheet Q is zero. The white circle corresponds to the reference point. In a lower area of FIG. 12, a black circle indicates an intersection between the first pattern element PE1 and the second pattern element PE2 when the second pattern element PE2 is formed in a situation where a sheet conveyance distance is shorter than when the conveyance distance error is zero and where the sheet Q is positioned |ΔY| upstream in the sheet conveyance direction relative to a position of the sheet Q when the conveyance distance error is zero. As understood from positional relationships shown in FIG. 12, a relationship between the conveyance distance error ΔY in the sub scanning direction and the positional displacement ΔX between the intersection and the reference point in the main scanning direction is expressed as follows.

$$\Delta Y=\Delta X*(\tan\theta 2-\tan\theta 1)$$

In the above expression, tan θ1 corresponds to an inclination of the first pattern element PE1 (i.e., the virtual straight line LN1). Further, tan θ2 corresponds to an inclination of the second pattern element PE2 (i.e., the virtual straight line LN2). When ΔY is a positive value, it denotes that the sheet Q is over-conveyed by |ΔY| downstream in the sheet conveyance direction in comparison with when the conveyance distance error is zero. When ΔY is a negative value, it denotes that the sheet Q is under-conveyed by |ΔY| upstream in the sheet conveyance direction in comparison with when the conveyance distance error is zero.

The controller 10 may calculate the conveyance distance error ΔY of the sheet Q by substituting the calculated positional displacement ΔX in the expression ΔY=ΔX*(tan θ2−tan θ1).

Thus, based on the aforementioned principle, the controller 10 may calculate a conveyance distance error ΔY of the sheet Q conveyed by the conveyance roller 613 rotating by the particular amount L1, with respect to each of the first test patterns TP1. Likewise, based on the position of the intersection between the third pattern element PE3 and the fourth pattern element PE4, the controller 10 may calculate a conveyance distance error ΔY of the sheet Q conveyed by the conveyance roller 613 rotating by the distance L0, with respect to each of the second test patterns TP2.

The controller 10 may analyze the conveyance distance error ΔY for each first test pattern TP1 and the conveyance distance error ΔY for each second test pattern TP2, and may calculate a periodic component E1 and an aperiodic component E2 of the conveyance distance error in the following method. In order to calculate the periodic component E1 and the aperiodic component E2 of the conveyance distance error, with respect to each of the test patterns TP1 and TP2, the controller 10 may associate a conveyance distance error ΔY caused when the test pattern has been formed, with a rotational phase φ and a rotational position Z of the conveyance roller 613 at a point of time when the test pattern has been formed. The rotational position Z may be understood as a rotation amount of the conveyance roller 613 that has rotated since the leading end of the sheet Q in the sheet conveyance direction reached the conveyance roller 613. In other words, the rotational position Z may understood as a rotation amount of the conveyance roller 613 in the case where a rotation amount of the conveyance roller 613 at a point of time when the conveyance roller 613 begins to convey the sheet Q is defined to be zero.

For the aforementioned association of the conveyance distance error ΔY with the rotational phase φ and the rotational position Z of the conveyance roller 613, in the test printing process, the controller 10 may store a rotational phase φ of the conveyance roller 613 at a point of time when the conveyance roller 613 begins to convey the sheet Q. By storing this initial value of the rotational phase φ of the conveyance roller 613, the controller 10 may specify the rotational phase φ of the conveyance roller 613 when each of the test patterns TP1 and TP2 is formed, from rules for forming the test patterns TP1 and TP2. Alternatively, the controller 10 may previously adjust the rotational phase of the conveyance roller 613 in such a manner that the conveyance roller 613 begins to convey the sheet Q from a rotational phase φ=0 in the test printing process or that the rotational phase φ is equal to zero when the head first pattern element PE1 is formed in the first forming process (S120).

In this case, the controller 10 may specify the rotational phase φ at the point of time when each of the test patterns TP1 and TP2 is formed, from the rules for forming the test patterns TP1 and TP2, without having to store the initial value of the rotational phase φ. Likewise, the controller 10 may specify the rotational position Z at the point of time when each of the test patterns TP1 and TP2 is formed, from the rules for forming the test patterns TP1 and TP2. Of course, with respect to each of all the pattern elements, the controller 10 may store a rotational phase φ and a rotational position Z at a point of time when the pattern element is formed.

Afterward, the controller 10 may calculate an average value of the conveyance distance errors ΔY derived from the test patterns TP1 formed at a same rotational phase φ ($0 \leq \varphi \leq 2\pi$) of the conveyance roller 613. Thereby, it is possible to calculate the periodic component E1 of the conveyance distance error ΔY at each rotational phase φ of the conveyance roller 613.

For instance, when K=6, and a first pattern element PE1 is formed at a rotational phase φ of zero degrees, a first test pattern TP1 including the first pattern element PE1 is formed with a change of the rotational phase φ from 0 degrees to 60 degrees. In other words, this first test pattern TP1 is formed by a combination (or a pair) of the first pattern element PE1 formed when the rotational phase φ of the conveyance roller 613 is equal to zero degrees and a second pattern element PE2 formed when the rotational phase φ of the conveyance roller 613 is equal to 60 degrees. The conveyance distance error ΔY derived from this first test pattern TP1 is a conveyance distance error of the sheet Q conveyed by the conveyance roller 613 rotating from a rotational phase φ of 0 degrees to a rotational phase φ of 60 degrees. Following this first test pattern 1, first test patterns 1 are sequentially formed on the sheet Q with a change of the rotational phase φ from 60 degrees to 120 degrees, a change of the rotational phase φ from 120 degrees to 180 degrees, a change of the rotational phase φ from 180 degrees to 240 degrees, a change of the rotational phase φ from 240 degrees to 300 degrees, and a change of the rotational phase φ from 300 degrees to 360 degrees, respectively.

In this case, the controller 10 may calculate an average value of the conveyance distance errors ΔY derived from respective first test patterns TP1 formed with the same change of the rotational phase φ from 0 degrees to 60 degrees in a plurality of rotations of the conveyance roller 613. Thereby, the controller 10 may determine the calculated average value as a periodic component E1 (φ=30 degrees) of the conveyance distance error ΔY caused within a range of the rotational phase φ from 0 degrees to 60 degrees, as shown in FIG. 13. Here, "30 degrees" represents a center phase between a rotational phase φ of 0 degrees and a rotational phase φ of 60 degrees.

The aperiodic component E2 of the conveyance distance error ΔY is not correlated with the rotational phase φ. Therefore, when a plurality of conveyance distance errors ΔY caused at the same rotational phase φ are integrated, periodic components are accumulated and enhanced whereas aperiodic components are canceled in the integrated value. Accordingly, an aperiodic component included in the calculated average value of the conveyance distance errors ΔY is substantially equal to zero. Consequently, it is possible to calculate the periodic component E1 of the conveyance distance error ΔY.

Thus, from a group of respective conveyance distance errors ΔY derived from a plurality of first test patterns TP1 when K=6, it is possible to acquire a periodic component E1 (30 degrees) of the conveyance distance error ΔY in the range from a rotational phase φ of 0 degrees to a rotational phase φ of 60 degrees (the center phase φ=30 degrees). Further, likewise, it is possible to acquire therefrom a periodic component E1 (90 degrees) of the conveyance distance error ΔY in the range from a rotational phase φ of 60 degrees to a rotational phase φ of 120 degrees (the center phase φ=90 degrees). Further, likewise, it is possible to acquire therefrom a periodic component E1 (150 degrees) of the conveyance distance error ΔY in the range from a rotational phase φ of 120 degrees to a rotational phase φ of 180 degrees (the center phase φ=150 degrees). Further, likewise, it is possible to acquire therefrom a periodic component E1 (210 degrees) of the conveyance distance error ΔY in the range from a rotational phase φ of 180 degrees to a rotational phase φ of 240 degrees (the center phase φ=210 degrees). Further, likewise, it is possible to acquire therefrom a periodic component E1 (270 degrees) of the conveyance distance error ΔY in the range from a rotational phase φ of 240 degrees to a rotational phase φ of 300 degrees (the center phase φ=270 degrees). Further, likewise, it is possible to acquire therefrom a periodic component E1 (330 degrees) of the conveyance distance error ΔY in the range from a rotational phase φ of 300 degrees to a rotational phase φ of 360 degrees (the center phase φ=330 degrees).

The controller 10 may calculate the periodic components E1 (30 degrees), E1 (90 degrees), E1 (150 degrees), E1 (210 degrees), E1 (270 degrees), and E1 (330 degrees) in the following method. Specifically, the controller 10 may approximate the periodic components E1 of the conveyance distance error ΔY by the following sine function.

$$E1(\varphi)=A\cdot\sin(\varphi-\gamma),$$

where A and γ represent an amplitude and an eccentric phase as unknown parameters, respectively. Thus, the controller 10 may calculate the amplitude A and the eccentric phase γ, thereby calculating the periodic components E1 of the conveyance distance error ΔY as the above function E1 (φ) of the rotational phase φ of the conveyance roller 613. Alternatively, more easily, the controller 10 may substitute a phase φ for the maximum value of the periodic components E1 (30 degrees), E1 (90 degrees), E1 (150 degrees), E1 (210 degrees), E1 (270 degrees), and E1 (330 degrees) in the following equation.

$$\varphi-\gamma=\pi/2$$

Thereby, the controller 10 may calculate the eccentric phase γ. Further, the controller 10 may regard the maximum value as the amplitude A. Thus, the controller 10 may calculate the periodic components E1 of the conveyance distance error ΔY as the above function E1 (φ) of the rotational phase φ of the conveyance roller 613.

Meanwhile, using respective conveyance distance errors ΔY derived from a plurality of second test patterns TP2, the controller 10 may calculate the aperiodic component E2 of the conveyance distance error ΔY in the following method. The conveyance distance error ΔY derived from each second test pattern TP2 is a conveyance distance error ΔY caused when the conveyance roller 613 makes a single rotation, and does not contain a periodic component. Nonetheless, a conveyance distance error ΔY directly acquired from a second test pattern TP2 is an accumulated value of conveyance distance errors caused while the conveyance roller 613 makes a single rotation. Namely, the conveyance distance error ΔY directly acquired from the second test pattern TP2 is a low-resolution conveyance distance error. On the other hand, it is possible to calculate the aperiodic component E2 with a high resolution corresponding to the particular amount L1 as a distance interval for forming the second test patterns TP2, by calculating the aperiodic component E2 of the conveyance distance error ΔY in the following method.

In order to acquire a high-resolution aperiodic component E2, a difference between respective conveyance distance errors ΔY derived from two second test patterns TP2 adjoining in the sub scanning direction may be used. Suppose for instance that a conveyance distance error ΔY, derived from a first-positioned one of the second test patterns TP2 from the leading end of the sheet Q in the sheet conveyance direction, is a value ΔY [1]. Further, suppose for instance that a conveyance distance error ΔY, derived from a second-positioned one of the second test patterns TP2 from the leading end of the sheet Q in the sheet conveyance direction, is a value ΔY [2]. Further, suppose for instance that the third pattern element PE3 included in the first-positioned second test pattern TP2 is formed when the conveyance roller 613 stays in a rotational position Z=a. Further, suppose for instance that the third pattern element PE3 included in the second-positioned second test pattern TP2 is formed when the conveyance roller 613 stays in a rotational position Z=α+L1. In this case, as shown in FIG. 15, a difference (ΔY [2]−ΔY [1]) between the value ΔY [2] and the value ΔY [1] corresponds to a difference (E [α+L0+L1/2]−E [α+L1/2]) between a conveyance distance error E [α+L0+L1/2] caused by the conveyance roller 613 rotating from a rotational position Z=α+L0 to a rotational position Z=α+L0+L1 and a conveyance distance error E [α+L1/2] caused by the conveyance roller 613 rotating from the rotational position Z=α to the rotational position Z=α+L1.

In generalized expressions, a conveyance distance error ΔY derived from an m-th-positioned one of the second test patterns TP2 from the leading end of the sheet Q in the sheet conveyance direction is a value ΔY [m]. Further, a conveyance distance error ΔY derived from an (m+1)-th-positioned one of the second test patterns TP2 from the leading end of the sheet Q in the sheet conveyance direction is a value ΔY [m+1]. As shown in FIG. 16, a difference (ΔY [m+1]−ΔY [m]) between the above two values corresponds to a difference (E [α+L0+(m−½)*L1]−E [α+(m−½)*L1]) between a conveyance distance error E [a+L0+(m−½)*L1] caused by the conveyance roller 613 rotating from a rotational position Z=α+L0+(m−1)*L1 to a rotational position Z=α+L0+m*L1 and a conveyance distance error E [α+(m−½)*L1] caused by the conveyance roller 613 rotating from a rotational position Z=α+(m−1)*L1 to a rotational position Z=α+m*L1. Here, a section from the rotational position Z=α+(m−1)*L1 to the rotational position Z=α+m*L1 may be referred to as a first section. A section from the rotational position Z=α+L0+(m−1)*L1 to the rotational position Z=α+L0+m*L1 may be referred to as a second section.

The difference (ΔY [m+1]−ΔY [m]) may be calculated based on the conveyance distance error ΔY derived from each of the second test patterns TP2 in S290. Accordingly, if there exists a particular section of the rotational position Z in which the conveyance distance error ΔY contains an aperiodic component E2 equal to zero, from the difference (ΔY [m+1]−ΔY [m]) when one of the first section and the second section is such a particular section, it is possible to calculate an aperiodic component E2 of the conveyance distance error ΔY in the other one of the first and second sections. Namely, it is possible to calculate the aperiodic component E2 of the conveyance distance error ΔY in the other section based on the difference (ΔY [m+1]−ΔY [m]).

Thus, in the illustrative embodiment, as described above, the controller 10 may calculate the difference (ΔY [m+1]−ΔY [m]) between respective conveyance distance errors ΔY derived from two second test patterns TP2 adjoining in the sub scanning direction. Then, on the basis of a particular section in which an aperiodic component is equal to zero or negligibly small, the controller 10 may calculate an aperiodic component E2 in another section close to the particular section. Consequently, it is possible to accurately calculate the aperiodic component E2 (Z) of the conveyance distance error ΔY for each rotational position Z. For instance, the particular section in which the aperiodic component is equal to zero or negligibly small may include, but is not limited to, a section in which the sheet Q is stably conveyed by a plurality of rollers. In the illustrative embodiment, for instance, a section in which the sheet Q is conveyed by the pickup roller 617, the conveyance roller 613, and the discharge roller 615 of the sheet conveyor 61 may be an example of the particular section in which an aperiodic component of the conveyance distance error is deemed to be smaller than those for any other sections.

According to the aforementioned principle, in S300, the controller 10 may calculate the periodic component E1 (E1 (φ)=A·sin (φ−γ)) of the conveyance distance error ΔY, and calculates the aperiodic component E2 (Z) every interval of the particular amount L1. Further, in S310, the controller 10 may store, into the NVRAM 17, the particular control parameters that represent the association between the rotation amount of the conveyance roller 613 and the sheet conveyance distance. The stored particular control parameters may include the parameters A and γ for defining the periodic component E1 (φ), and the aperiodic component E2 (Z) in each rotational position Z that is discrete at intervals of the particular amount L1, into the NVRAM 17, as particular control parameters that represent the association between the rotation amount of the conveyance roller 613 and the sheet conveyance distance. Thus, the controller 10 may rewrite and update the control parameters stored in the NVRAM 17, and may adjust sheet conveyance to suppress the conveyance distance error based on the updated control parameters.

Hereinabove, the MFP 1 of the illustrative embodiment has been described. In the illustrative embodiment, each second test pattern TP2 is formed by a fourth pattern element PE4 being superimposed on a third pattern element PE3 when the conveyance roller 613 has made a single rotation since the third pattern element PE3 was formed. Further, each first test pattern TP1 is formed by a second pattern element PE2 being superimposed on a first pattern element PE1 when the conveyance roller 613 has made a single rotation divided by an integer since the first pattern element PE1 was formed. Accordingly, it is possible to specify the periodic component E1 of the conveyance distance error of the sheet Q from a group of the first test patterns TP1. Further, it is possible to specify the aperiodic component E2 of the conveyance distance error of the sheet Q from a group of the second test patterns TP2.

Consequently, in the illustrative embodiment, by summing a periodic component E1 resulting from substituting a rotational phase φ of the conveyance roller 613 in the function E1 (φ) and an aperiodic component E2 (Z) corresponding to a rotational position Z of the conveyance roller 613, it is possible to previously calculate a conveyance distance error of the sheet Q with high accuracy and perform rotation control of the conveyance roller 613 to suppress the conveyance distance error.

Accordingly, in the illustrative embodiment, it is possible to perform sheet conveyance control with higher accuracy than a known technique for adjusting sheet conveyance only in consideration of a periodic component of the conveyance distance error of the sheet Q. Thus, in the illustrative embodiment, it is possible to form a high-quality image on a sheet Q with an inkjet-type image forming apparatus such as the MFP 1 configured to convey the sheet Q over a predetermined distance and form the image on the sheet Q by discharging ink droplets from the recording head 40.

In particular, according to the illustrative embodiment, the first test patterns TP1 and the second test patterns TP2 are formed to be arranged at regular intervals of the same distance (i.e., the particular amount L1) in the sub scanning direction. Therefore, it is possible to make detailed and accurate detection of the periodic component and the aperiodic component of the conveyance distance error with the same resolution.

Further, in the illustrative embodiment, a phase interval for forming the third pattern element PE3 and the fourth pattern element PE4 included in each second pattern TP2 is set to a single rotation (i.e., 360 degrees) of the conveyance roller 613. Thereby, the conveyance distance error ΔY derived from the second test patterns TP2 does not contain a periodic component. Accordingly, in the illustrative embodiment, it is possible to accurately specify the aperiodic component of the conveyance distance error from the second test patterns TP2 without the need for complicated calculation.

Further, in the illustrative embodiment, in order to accurately calculate the conveyance distance error ΔY from the test patterns TP1 and TP2, the two pattern elements included in each of the test patterns TP1 and TP2 are formed to be inclined relative to the main scanning direction. The positional displacement in the main scanning direction, caused by the conveyance distance error ΔY, of the intersection between the two pattern elements included in each of the test patterns TP1 and TP2 is more amplified as the angle (the difference between the angles θ2 and θ1) between the two pattern elements included in each of the test patterns TP1 and TP2 becomes smaller. In the illustrative embodiment, since the mutually-intersecting two pattern elements included in each of the test patterns TP1 and TP2 are inclined relative to the main scanning direction, it is possible to make the angle therebetween smaller. Accordingly, in the illustrative embodiment, it is possible to accurately calculate the conveyance distance error ΔY from the test patterns TP1 and TP2 formed in the aforementioned manner. Consequently, it is possible to accurately adjust conveyance of a sheet Q and form a high-quality image on the sheet Q.

As an example of known methods for forming test patterns, a method has been known in which a straight-line-shaped pattern element parallel to the main scanning direction is formed on a sheet as a first pattern element, and a straight-line-shaped pattern element inclined relative to the main scanning direction is formed on the sheet as a second pattern element in a manner superimposed on the first pattern element. However, according to the known method, it is impossible to sufficiently make small an angle between the first pattern element and the second pattern element, because of the restriction on a resolution (i.e., a dot pitch) of an image formable by the recording head 40 in the sub scanning direction. According to the method for forming test patterns in the illustrative embodiment, it is possible to calculate the conveyance distance error ΔY with much higher accuracy than the known method.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

(Modifications)

In the aforementioned illustrative embodiment, an individual first test pattern TP1 and a corresponding second test pattern TP2 are formed substantially in a row along the main scanning direction. Nonetheless, an individual first test pattern TP1 and a corresponding second test pattern TP2 may be formed in mutually-different positions in the sub scanning direction. Further, the second pattern element PE2 included in each first test pattern TP1 may not necessarily be formed to intersect the corresponding first pattern element PE1. For instance, as shown in FIG. 17, the second pattern element PE2 included in each first test pattern TP1 may be formed to be in proximity to but not intersect the corresponding first pattern element PE1. Even though the first pattern element PE1 and the second pattern element PE2 are formed in this manner, by virtually extending the first pattern element PE1 and the second pattern element PE2 and calculating a position of an imaginary intersection therebetween, it is possible to calculate the conveyance distance error of the sheet Q in the sub scanning direction substantially in the same method as described in the aforementioned illustrative embodiment.

Further, the pattern elements included in each first test pattern TP1 may not necessarily have the same shapes as the pattern elements included in each second test pattern TP2. In a group of the first test patterns TP1 arranged in the sub scanning direction, one first test pattern TP1 may include pattern elements shaped differently from pattern elements included in another first test pattern TP1. The group of the first test patterns TP1 and the group of the second test patterns TP2 may not necessarily be arranged in parallel in the main scanning direction. However, as the group of the first test patterns TP1 and the group of the second test patterns TP2 are arranged in parallel in the main scanning direction, it is possible to place the two groups in a small area. Thus, it is possible to print a plurality of kinds of test patterns on a single recording medium.

Further, the third pattern element PE3 and the fourth pattern element PE4 included in each second test pattern TP2 may be formed at phase intervals of two or more rotations of the conveyance roller 613. In other words, the distance L0 may be a distance corresponding to two or more rotations of the conveyance roller 613. Furthermore, the third pattern element PE3 and the fourth pattern element PE4 included in each second test pattern TP2 may be formed at phase intervals of half a rotation of the conveyance roller 613. In other words, the distance L0 may be a distance corresponding to half a rotation of the conveyance roller 613. Nonetheless, in this case, the controller 10 may calculate a conveyance distance error caused when the conveyance roller 613 makes half a rotation, based on the position of the intersection of each second test pattern TP2, and may add one conveyance distance error to another to determine a conveyance distance error caused by a single rotation of the conveyance roller 613. Hence, in the case, the accuracy for detecting the aperiodic component of the conveyance distance error might become somewhat lower.

In the aforementioned illustrative embodiment, the controller 10 calculates the periodic component E1 of the conveyance distance error by averaging the conveyance distance error ΔY derived from each first test pattern TP1 formed at the same rotational phase φ of the conveyance roller 613. Nonetheless, the controller 10 may determine an amplitude A and an eccentric phase γ by fitting the conveyance distance error ΔY derived from each first test pattern TP1 to the sine function.

Further, the controller 10 may firstly calculate the aperiodic component E2 of the conveyance distance error based on the second test patterns TP2, then correct the conveyance distance error ΔY by subtracting the calculated aperiodic component E2 from the conveyance distance error ΔY derived from each first test pattern TP1, and thereafter fit the corrected conveyance distance error ΔY to the sine function. Thereby, it is possible to determine an amplitude A and an eccentric phase γ.

Thus, although the accuracy for calculating the conveyance distance error varies depending on the calculating methods, it is possible to specify the periodic component and the aperiodic component of the conveyance distance error in various methods, based on the conveyance distance error derived from the first test patterns TP1 and the conveyance distance error derived from the second test patterns TP2. Therefore, according to aspects of the present disclosure, the method for analyzing and calculating the conveyance distance error is not particularly limited. Considering that the control parameters may be updated before product shipment, the conveyance distance error may be analyzed by an apparatus different from the MFP 1. For instance, the steps S290 to S310 may be executed by a separate apparatus for updating the control parameters that is different from the MFP 1. The apparatus for updating the control parameters may have a scanning function. In this case, the apparatus for updating the control parameters may be further configured to execute the steps S270 and S280. Aspects of the present disclosure may be applied to an image forming apparatus without a scanning function. In this case, the aforementioned separate apparatus may be provided for updating the control parameters before product shipment or at a maintenance time.

Aspects of the present disclosure may be applied to line inkjet printers and laser printers. Suppose for instance that aspects of the present disclosure are applied to a line inkjet printer that includes a plurality of line inkjet heads arranged in the sub scanning direction and configured to discharge ink droplets onto a sheet Q while the sheet Q is being conveyed. In this case, an upstream one of the line inkjet heads in the sheet conveyance direction may form the first pattern elements PE1 and the third pattern elements PE3. Further, a downstream one of the line inkjet heads in the sheet conveyance direction may form the second pattern elements PE2. Moreover, a further downstream one of the line inkjet heads in the sheet conveyance direction may form the fourth pattern elements PE4.

With respect to associations of elements exemplified in the aforementioned illustrative embodiment with elements to be defined according to aspects of the present disclosure, the conveyance roller 613 of the sheet conveyor 61 may be an example of a "conveyor" according to aspects of the present disclosure. Further, the recording head 40 may be an example of an "image former" according to aspects of the present disclosure. In addition, the first nozzle group N1 of the recording head 40 may be examples of a "first section" and a "third section" of a plurality of image forming sections included in the image former according to aspects of the present disclosure. Further, the second nozzle group N2 of the recording head 40 may be an example of a "second section" of the plurality of image forming sections included in the image former according to aspects of the present disclosure. Further, the third nozzle group N3 of the recording head 40 may be an example of a "fourth section" of the plurality of image forming sections included in the image former according to aspects of the present disclosure. Further, the particular amount L1 may be an example of a rotation amount when the conveyor rotates by a "first amount" according to aspects of the present disclosure. Further, the particular amount L1 may be an example of a "particular distance" corresponding to the first amount according to aspects of the present disclosure. Further, the distance L0 may be an example of a rotation amount when the conveyor rotates by a "second amount" according to aspects of the present disclosure. Further, the distance L0 may be an example of a "specific distance" corresponding to the second amount according to aspects of the present disclosure. Further, the controller 10 may be an example of a "controller" according to aspects of the present disclosure. Alternatively, a combination of the controller 10 and the printing unit driver 30 may be an example of the "controller" according to aspects of the present disclosure.

What is claimed is:

1. An image forming apparatus comprising:

a conveyor configured to, while rotating, convey a recording medium in a conveyance direction;

an image former configured to form an image on the recording medium conveyed by the conveyor; and a controller configured to perform a test pattern forming process to form on the recording medium a plurality of first test patterns arranged in the conveyance direction and a plurality of second test patterns arranged in the conveyance direction, each first test pattern comprising a pair of a first pattern element and a second pattern element, each second test pattern comprising a pair of a third pattern element and a fourth pattern element, the test pattern forming process comprising:

controlling the image former to form a first pattern element on the recording medium;

after the first pattern element is formed, controlling the conveyor to rotate by a first amount and convey the recording medium with the first pattern element formed thereon over a particular distance corresponding to the first amount in the conveyance direction;

after the first pattern element formed on the recording medium is conveyed over the particular distance in the conveyance direction in response to the conveyor rotating by the first amount, controlling the image former to form a second pattern element to be paired with the first pattern element formed on the recording medium thereby forming a first test pattern, and form an unpaired first pattern element;

after the unpaired first pattern element is formed, each time the unpaired first pattern formed on the recording medium is conveyed over the particular distance in the conveyance direction in response to the conveyor rotating by the first amount, controlling the image former to form another second pattern element to be paired with the unpaired first pattern element thereby forming another first test pattern;

controlling the image former to form a third pattern element on the recording medium;

after the third pattern element is formed, controlling the conveyor to rotate by a second amount and convey the recording medium with the third pattern element formed thereon over a specific distance corresponding to the second amount in the conveyance direction, wherein the second amount is different from the first amount, and at least one of the first amount and the second amount is a non-integer multiple of a rotation amount of the conveyor that makes a single rotation;

after the third pattern element formed on the recording medium is conveyed over the specific distance in the conveyance direction in response to the conveyor rotating by the second amount, controlling the image former to form a fourth pattern element to be paired with the third pattern element formed on the recording medium thereby forming a second test pattern, and form an unpaired third pattern element; and after the unpaired third pattern element is formed, each time the unpaired third pattern formed on the recording medium is conveyed over the specific distance in the conveyance direction in response to the conveyor rotating by the second amount, controlling the image former to form another fourth pattern element to be paired with the unpaired third pattern element thereby forming another second test pattern.

2. The image forming apparatus according to claim 1, wherein the controller is further configured to, in the test pattern forming process, control the conveyor and the image former to form a group of the plurality of second test patterns in parallel with a group of the plurality of the first test patterns.

3. The image forming apparatus according to claim 2, wherein the controller is further configured to, in the test pattern forming process, control the conveyor and the image former to form the plurality of the first test patterns at intervals of a fixed distance in the conveyance direction and form the plurality of the second test patterns at intervals of the fixed distance in the conveyance direction.

4. The image forming apparatus according to claim 2, wherein the second amount is an integer multiple of the rotation amount of the conveyor that makes a single rotation, the integer being equal to or more than one, and wherein the first amount is less than the rotation amount of the conveyor that makes a single rotation.

5. The image forming apparatus according to claim 2, wherein the image former comprises a plurality of image forming sections, each of which is configured to form an image on the recording medium, and wherein the controller is further configured to control the image former to:

form the first pattern elements included in the plurality of first test patterns with a first section of the image forming sections;

form the second pattern elements included in the plurality of first test patterns with a second section of the image forming sections, the second section being positioned the particular distance downstream of the first section in the conveyance direction, the particular distance corresponding to the first amount;

form the third pattern elements included in the plurality of second test patterns with a third section of the image forming sections; and form the fourth pattern elements included in the plurality of second test patterns with a fourth section of the image forming sections, the fourth section being positioned the specific distance downstream of the third section in the conveyance direction, the specific distance corresponding to the second amount.

6. The image forming apparatus according to claim 5, wherein the image former comprises a recording head, the recording head comprising a plurality of nozzles arranged in the conveyance direction, the image former being configured to form an image on the recording medium by discharging ink droplets from the plurality of nozzles, wherein the first section of the image forming sections comprises one or more nozzles of the plurality of nozzles, wherein the second section of the image forming sections comprises one or more nozzles of the plurality of nozzles, the one or more nozzles included in the second section being positionally different from the one or more nozzles included in the first section in the conveyance direction, wherein the third section of the image forming sections comprises one or more nozzles of the plurality of nozzles, and wherein the fourth section of the image forming sections comprises one or more nozzles of the plurality of nozzles, the one or more nozzles included in the fourth section being positionally different from the one or more nozzles included in the third section in the conveyance direction.

7. The image forming apparatus according to claim 5, wherein the controller is further configured to, in the test pattern forming process, repeatedly perform a particular control process in accordance with a progress in conveying the recording medium by the conveyor, the particular control process comprising:

controlling the image former to form each first pattern element with the first section; and controlling the image former to form each third pattern element with the third section.

8. The image forming apparatus according to claim 5, wherein the third section is identical to the first section, and wherein the controller is further configured to, in the test pattern forming process, repeatedly perform a particular control process in accordance with a progress in conveying the recording medium by the conveyor, the particular control process comprising controlling the image former to form each first pattern element and each third pattern element with the first section.

9. The image forming apparatus according to claim 7, wherein the particular distance corresponding to the first amount is equal to the specific distance divided by an integer, the specific distance corresponding to the second amount, and wherein the controller is further configured to, in the test pattern forming process, control the conveyor and the image former to form the first test patterns in parallel at regular intervals of the particular distance and form the second test patterns in parallel at regular intervals of the particular distance, by:

controlling the conveyor and the image former to form each first pattern element at regular intervals of the particular distance, and form each third pattern element at regular intervals of the particular distance; and controlling the image former to form each second pattern element with the second section and form each fourth pattern element with the fourth section, each time the recording medium is conveyed over the particular distance corresponding to the first amount by controlling the conveyor to rotate by the first amount.

10. The image forming apparatus according to claim 8, wherein the particular distance corresponding to the first amount is equal to the specific distance divided by an integer, the specific distance corresponding to the second amount, and wherein the controller is further configured to, in the test pattern forming process, control the conveyor and the image former to form the first test patterns in parallel at regular intervals of the particular distance and form the second test patterns in parallel at regular intervals of the particular distance, by:

controlling the conveyor and the image former to form each first pattern element at regular intervals of the particular distance, and form each third pattern element at regular intervals of the particular distance; and controlling the image former to form each second pattern element with the second section and form each fourth pattern element with the fourth section, each time the recording medium is conveyed over the particular distance corresponding to the first amount by controlling the conveyor to rotate by the first amount.

11. The image forming apparatus according to claim 2, wherein the particular distance corresponding to the first amount is equal to the specific distance divided by an integer, the specific distance corresponding to the second amount, and wherein the controller is further configured to, in the test pattern forming process, control the conveyor and the image former to form the first test patterns at regular intervals of the particular distance and form the second test patterns at regular intervals of the particular distance.

12. The image forming apparatus according to claim 1, wherein the controller is further configured to, in the test pattern forming process, control the conveyor and the image former to:

form each first test pattern by placing each of the second pattern elements to intersect or be in proximity to a corresponding one of the first pattern elements, each first pattern element being formed in one of a linear shape and a terraced shape and inclined relative to a direction perpendicular to the conveyance direction, each second pattern element being formed in one of a linear shape and a terraced shape and inclined relative to each of the direction perpendicular to the conveyance direction and the first pattern elements; and form each second test pattern by placing each of the fourth pattern elements to intersect or be in proximity to a corresponding one of the third pattern elements, each third pattern element being formed in one of a linear shape and a terraced shape and inclined relative to the direction perpendicular to the conveyance direction, each fourth pattern element being formed in one of a linear shape and a terraced shape and inclined relative to each of the direction perpendicular to the conveyance direction and the third pattern elements.

13. The image forming apparatus according to claim 1, further comprising a scanner configured to scan the first test patterns and the second test patterns formed on the recording medium, and wherein the controller is further configured to calculate a periodic component and an aperiodic component of a conveyance distance error of the recording medium caused when the recording medium is conveyed by the conveyor, based on a positional relationship between the first pattern element and the second pattern element included in each of the first test patterns scanned by the scanner and a positional relationship between the third pattern element and the fourth pattern element included in each of the second test patterns scanned by the scanner.

14. The image forming apparatus according to claim 13, wherein the controller is further configured to:

specify a rotational phase and a rotational position of the conveyor when each of the first test patterns is formed, and specify a rotational phase and a rotational position of the conveyor when each of the second test patterns is formed; and based on the specified rotational phases and the specified rotational positions, calculate the periodic component of the conveyance distance error at each rotational phase of the conveyor, and calculate the aperiodic component of the conveyance distance error in each rotational position of the conveyor.

15. The image forming apparatus according to claim 13, wherein the controller is further configured to:

control the conveyor to convey the recording medium in accordance with control parameters; and based on the calculated conveyance distance error of the recording medium, correct the control parameters to suppress the conveyance distance error.

16. The printer according to claim 1, wherein the controller comprises:

a processor; and a memory storing processor-executable instructions configured to, when executed by the processor, cause the processor to perform the test pattern forming process.

17. A method implementable on a processor coupled with an image forming apparatus comprising a conveyor and an image former, the method comprising:

controlling the image former to form a first pattern element on a recording medium;

after the first pattern element is formed, controlling the conveyor to rotate by a first amount and convey the recording medium with the first pattern element formed thereon over a particular distance corresponding to the first amount in a conveyance direction;

after the first pattern element formed on the recording medium is conveyed over the particular distance in the conveyance direction in response to the conveyor rotating by the first amount, controlling the image former to form a second pattern element to be paired with the first pattern element formed on the recording medium thereby forming a first test pattern, and form an unpaired first pattern element, the first test pattern comprising the pair of the first pattern element and the second pattern element;

after the unpaired first pattern element is formed, each time the unpaired first pattern formed on the recording medium is conveyed over the particular distance in the conveyance direction in response to the conveyor rotating by the first amount, controlling the image former to form another second pattern element to be paired with the unpaired first pattern element thereby forming another first test pattern;

controlling the image former to form a third pattern element on the recording medium;

after the third pattern element is formed, controlling the conveyor to rotate by a second amount and convey the recording medium with the third pattern element formed thereon over a specific distance corresponding to the second amount in the conveyance direction, wherein the second amount is different from the first amount, and at least one of the first amount and the second amount is a non-integer multiple of a rotation amount of the conveyor that makes a single rotation;

after the third pattern element formed on the recording medium is conveyed over the specific distance in the conveyance direction in response to the conveyor rotating by the second amount, controlling the image former to form a fourth pattern element to be paired with the third pattern element formed on the recording medium thereby forming a second test pattern, and form an unpaired third pattern element, the second test pattern comprising the pair of the third pattern element and the fourth pattern element; and after the unpaired third pattern element is formed, each time the unpaired third pattern formed on the recording medium is conveyed over the specific distance in the conveyance direction in response to the conveyor rotating by the second amount, controlling the image former to form another fourth pattern element to be paired with the unpaired third pattern element thereby forming another second test pattern.

18. The method according to claim 17, further comprising:

controlling a scanner coupled with the processor to scan the first test patterns and the second test patterns formed on the recording medium; and calculating a periodic component and an aperiodic component of a conveyance distance error of the recording medium caused when the recording medium is conveyed by the conveyor, based on a positional relationship between the first pattern element and the second pattern element included in each of the first test patterns scanned by the scanner and a positional relationship between the third pattern element and the fourth pattern element included in each of the second test patterns scanned by the scanner.

19. A non-transitory computer-readable medium storing computer-readable instructions executable on a processor coupled with an image forming apparatus comprising a conveyor and an image former, the instructions being configured to, when executed by the processor, cause the processor to:

control the image former to form a first pattern element on a recording medium;

after the first pattern element is formed, control the conveyor to rotate by a first amount and convey the recording medium with the first pattern element formed thereon over a particular distance corresponding to the first amount in a conveyance direction;

after the first pattern element formed on the recording medium is conveyed over the particular distance in the conveyance direction in response to the conveyor rotating by the first amount, control the image former to form a second pattern element to be paired with the first pattern element formed on the recording medium thereby forming a first test pattern, and form an unpaired first pattern element, the first test pattern comprising the pair of the first pattern element and the second pattern element;

after the unpaired first pattern element is formed, each time the unpaired first pattern formed on the recording medium is conveyed over the particular distance in the conveyance direction in response to the conveyor rotating by the first amount, control the image former to form another second pattern element to be paired with the unpaired first pattern element thereby forming another first test pattern;

control the image former to form a third pattern element on the recording medium;

after the third pattern element is formed, control the conveyor to rotate by a second amount and convey the recording medium with the third pattern element formed thereon over a specific distance corresponding to the second amount in the conveyance direction, wherein the second amount is different from the first amount, and at least one of the first amount and the second amount is a non-integer multiple of a rotation amount of the conveyor that makes a single rotation;

after the third pattern element formed on the recording medium is conveyed over the specific distance in the conveyance direction in response to the conveyor rotating by the second amount, control the image former to form a fourth pattern element to be paired with the third pattern element formed on the recording medium thereby forming a second test pattern, and form an unpaired third pattern element, the second test pattern comprising the pair of the third pattern element and the fourth pattern element; and after the unpaired third pattern element is formed, each time the unpaired third pattern formed on the recording medium is conveyed over the specific distance in the conveyance direction in response to the conveyor rotating by the second amount, control the image former to form another fourth pattern element to be paired with the unpaired third pattern element thereby forming another second test pattern.

20. The non-transitory computer-readable medium according to claim 19, wherein the instructions are further configured to, when executed by the processor, cause the processor to:

control a scanner coupled with the processor to scan the first test patterns and the second test patterns formed on the recording medium; and calculate a periodic component and an aperiodic component of a conveyance distance error of the recording medium caused when the recording medium is conveyed by the conveyor, based on a positional relationship between the first pattern element and the second pattern element included in each of the first test patterns scanned by the scanner and a positional relationship between the third pattern element and the fourth pattern element included in each of the second test patterns scanned by the scanner.

* * * * *